US010218071B2

(12) United States Patent
Toyao

(10) Patent No.: US 10,218,071 B2
(45) Date of Patent: Feb. 26, 2019

(54) ANTENNA AND ELECTRONIC DEVICE

(71) Applicant: Hiroshi Toyao, Tokyo (JP)

(72) Inventor: Hiroshi Toyao, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/299,125

(22) Filed: Oct. 20, 2016

(65) Prior Publication Data

US 2017/0040689 A1 Feb. 9, 2017

Related U.S. Application Data

(63) Continuation of application No. 14/239,527, filed as application No. PCT/JP2012/071433 on Aug. 24, 2012, now Pat. No. 9,496,616.

(30) Foreign Application Priority Data

Aug. 24, 2011 (JP) ..... 2011-182325
Feb. 8, 2012 (JP) ..... 2012-024848

(51) Int. Cl.
*H01Q 7/00* (2006.01)
*H01Q 13/10* (2006.01)
(Continued)

(52) U.S. Cl.
CPC ..... *H01Q 7/00* (2013.01); *H01P 5/107* (2013.01); *H01Q 1/48* (2013.01); *H01Q 13/10* (2013.01); *H01Q 13/16* (2013.01)

(58) Field of Classification Search
CPC ..... H01P 5/107; H01Q 7/00; H01Q 13/16; H01Q 13/10
See application file for complete search history.

(56) References Cited

U.S. PATENT DOCUMENTS 4,197,545 A 4/1980 Favaloro et al.
4,792,809 A 12/1988 Gilbert et al.
(Continued)

FOREIGN PATENT DOCUMENTS

CN 101389998 A 3/2009
CN 102456945 A 5/2012
(Continued)

OTHER PUBLICATIONS

Notice of Allowance in U.S. Appl. No. 14/239,527 dated Jul. 13, 2016.
(Continued)

*Primary Examiner* — Jessica Han
*Assistant Examiner* — Jae Kim
(74) *Attorney, Agent, or Firm* — McGinn I.P. Law Group, PLLC.

(57) ABSTRACT

An antenna includes a dielectric multilayer substrate that includes a first conductor layer and a second conductor layer different from the first conductor layer, the first conductor layer including a first conductor, the first conductor including a first split ring part, the first split ring part surrounding a first opening part and being divided by a first split part, and a power feed line that is provided on the second conductor layer, the power feed line including a first end and a second end, the first end being connected to the first split ring part, the second end spanning the first opening part and extending to a region opposing the first conductor.

20 Claims, 18 Drawing Sheets

(51) Int. Cl.

| | |
|---|---|
| ***H01Q 13/16*** | (2006.01) |
| ***H01P 5/107*** | (2006.01) |
| ***H01Q 1/48*** | (2006.01) |

(56) References Cited

U.S. PATENT DOCUMENTS

| | | | |
|---|---|---|---|
| 5,629,266 | A | 5/1997 | Lithgow |
| 5,949,377 | A | 9/1999 | Matsumoto et al. |
| 7,205,941 | B2 | 4/2007 | Wang |
| 8,314,740 | B2 | 11/2012 | Blumberg, Jr. |
| 8,502,741 | B2 | 8/2013 | Lin |
| 8,711,897 | B2 | 4/2014 | Miles |
| 2004/0021463 | A1 | 2/2004 | Miyazawa et al. |
| 2006/0176226 | A1 | 8/2006 | Moon et al. |
| 2007/0080864 | A1 | 4/2007 | Channabasappa |
| 2009/0160718 | A1 | 6/2009 | Yen et al. |
| 2010/0238079 | A1 | 9/2010 | Ayatollahi et al. |

FOREIGN PATENT DOCUMENTS

| | | | | |
|---|---|---|---|---|
| GB | 2 245 784 | A | | 1/1992 |
| JP | S 62-13004 | U | | 1/1987 |
| JP | 2003-114265 | A | | 4/2003 |
| JP | 2004-201265 | A | | 7/2004 |
| JP | 2007-155597 | A | | 6/2007 |
| JP | 2007155597 | A | * | 6/2007 |
| JP | 4242983 | B2 | | 3/2009 |
| JP | 4713367 | B2 | | 6/2011 |
| WO | WO 03/096480 | A1 | | 11/2003 |
| WO | WO 2007-091208 | A1 | | 8/2007 |

OTHER PUBLICATIONS

Japanese Notice of Allowance in JPA No. 2013-530070, dated Sep. 6, 2016, with an English translation.

Extended European Search Report dated Apr. 20, 2015.

Chinese Office Action dated Jan. 6, 2015 with an English translation thereof.

International Search Report in PCT/JP2012/071433 dated Nov. 27, 2012 (English Translation Thereof).

"Electrically small split ring resonator antennas", Journal of Applied Physics, 101, Aug. 31, 2004 (2007).

"Patch Antenna With Stacked Split Ring Resonators As an Artificial Magneto-Dielectric Substrate", Microwave and Optical Technology Letters, vol. 46, No. 6, Sep. 20, 2005.

European Office Action, dated Apr. 24, 2018, in European Application No. 12 825 436.4.

Chinese Office Action, dated Dec. 5, 2018, in Chinese Application No. 201610224304.5 and English Translation thereof.

* cited by examiner

ANTENNA AND ELECTRONIC DEVICE

The present application is a Continuation Application of U.S. patent application Ser. No. 14/239,527, filed on Feb. 18, 2014, which is based on International Application No. PCT/JP2012/071433, filed on Aug. 24, 2012, which is based on Japanese Patent Application No. 2011-182325, filed on Aug. 24, 2011, and Japanese Patent Application No. 2012-024848, filed on Feb. 8, 2012, the entire contents of which are incorporated herein by reference.

TECHNICAL FIELD

The present invention relates to an antenna and an electronic device.

BACKGROUND ART

It has become clear that periodically arranging a conductor pattern having a specific structure (hereunder denoted as a metamaterial) allows the propagation characteristics of electromagnetic waves to be controlled. The metamaterial known as the most basic components is a split ring part resonator using a C-shaped split ring part, in which a circular conductor is cut at a portion in the circumferential direction. A split ring part resonator is able to control the effective magnetic permeability by interacting with a magnetic field.

In electronic devices having a communication function, miniaturization is always desired. Accordingly, miniaturization of the antenna that performs the communication is also demanded. Therefore, techniques for miniaturization of the antenna by utilizing a split ring part resonator are being proposed.

Non-Patent Document 1 discloses a technique for miniaturizing a monopole antenna by making the effective magnetic permeance large by arranging a split ring part resonator in the vicinity of the monopole antenna.

Non-Patent Document 2 discloses a technique for miniaturizing a patch antenna by making the effective magnetic permeance large by periodically arranging a split ring part resonator in the region between the patch and the ground plane of a patch antenna.

PRIOR ART DOCUMENTS

Non-Patent Documents

[Non-Patent Document 1] "Electrically small split ring resonator antennas," Journal of Applied Physics, 101, 083104 (2007)

[Non-Patent Document 2] "Patch Antenna With Stacked Split-Ring Resonators As An Artificial Magneto-Dielectric Substrate," Microwave and Optical Technology Letters, Vol. 46, No. 6, Sep. 20, 2005

SUMMARY OF THE INVENTION

Problem to be Solved by the Invention

However, in both of the antennas disclosed in Non-Patent Documents 1 and 2, it is necessary to arrange the split ring part resonator that is separately provided for the monopole antenna or the patch antenna, perpendicularly with respect to the ground plane. Split ring part resonators arranged perpendicularly with respect to the ground plane cannot be integrally manufactured with the ground plane in a normal printed substrate manufacturing process. Consequently, there is a problem in that the manufacturing costs increase.

In the antenna disclosed in Non-Patent Document 2, by applying a split ring part resonator to a patch antenna that originally has a narrow operating band, there is a problem in that the operating band becomes even narrower.

The present invention has been achieved in light of the situation mentioned above. An exemplary object of the present invention is to provide an antenna that operates over a wide band while being compact, and can also be manufactured at a low cost, and an electronic device including this antenna.

Means for Solving the Problem

The present invention employs the following measures in order to solve the problems mentioned above.

An antenna according to an exemplary aspect of the present invention includes: a first conductor layer including a first split ring part surrounding a first opening part, the first split ring part having a first split part provided at a portion in a circumferential direction, the first split ring part being continuous in an approximate C-shape; a second conductor layer including a second split ring part opposing the first split ring part, the second split ring part surrounding a second opening part, the second split ring part having a second split part at a portion in a circumferential direction, the second split ring part being continuous in an approximate C-shape; a plurality of conductor vias provided with an interval in a circumferential direction of the first split part and the second split part, the conductor vias electrically connecting the first split ring part and the second split ring part; and a power feed line provided on a conductor layer different from the first conductor layer, the power feed line having a first end and second end, the first end being electrically connected to at least one of the conductor vias, the second end spanning the first and the second opening parts and extending to a region opposing the first split ring part.

An electronic device according to an exemplary aspect of the present invention includes at least one antenna described above.

Effect of the Invention

According to the present invention, a first conductor layer and a second conductor layer, which sandwich a dielectric layer and are opposing, respectively have a first split ring part and a second split ring part that are continuous in an approximate C-shape. By connecting the first split ring part and the second split ring part by means of conductor vias, a split ring part resonator itself can be made an antenna radiator. Consequently, an antenna can be formed at a low cost from just a dielectric multilayer substrate that, at the very least, includes a plurality of layers of conductor layers sandwiching a dielectric layer. Furthermore, such an antenna operates over a comparatively wide band since it does not use a patch antenna.

EMBODIMENTS FOR CARRYING OUT THE INVENTION

Hereunder, an antenna according to exemplary embodiments of the present invention is described with reference to the attached diagrams. However, the present invention is in no way limited to these exemplary embodiments.

First Exemplary Embodiment

Figure 1:
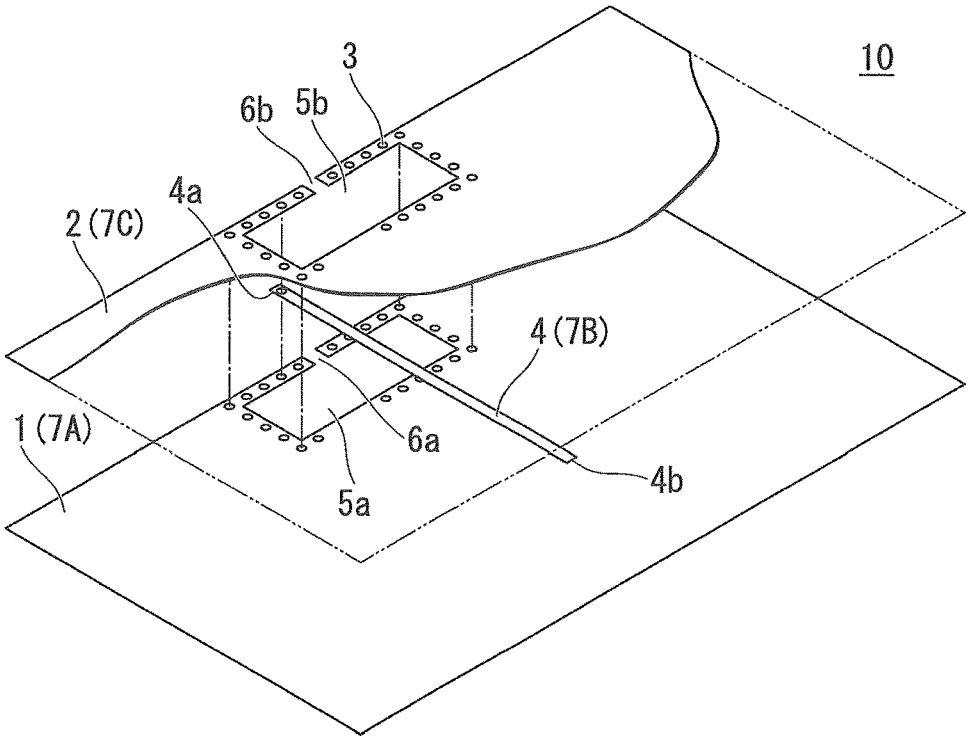
FIG. 1 is a perspective view showing an example of an antenna according to a first exemplary embodiment of the present invention.
Figure 2:
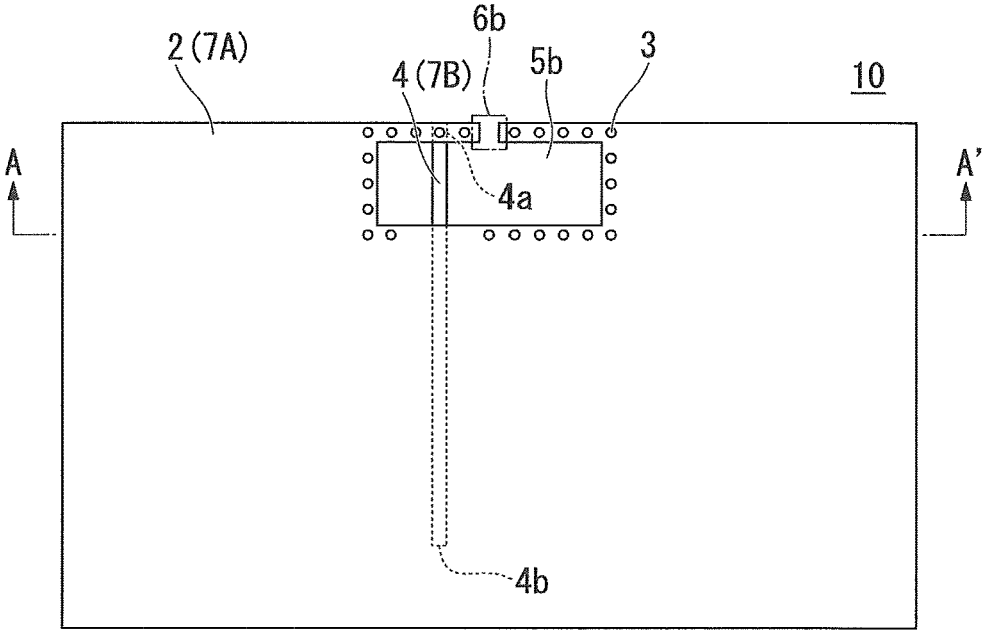
FIG. 2 is a top view of the antenna of FIG. 1.
Figure 3:
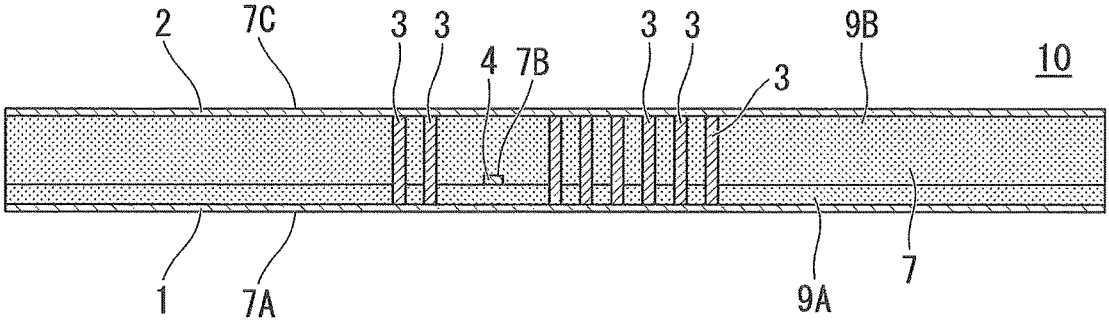
FIG. 3 is a cross-sectional view along line A-A' in FIG. 2.

As shown in FIG. 1 to FIG. 3, a dielectric multilayer substrate 7 is configured by alternatingly laminating a plurality of dielectric layers 9A and 9B and a conductor layer. An antenna 10 is, with respect to the dielectric multilayer substrate 7, configured by respectively sequentially forming a first split ring part 1, a power feed line 4, and a second split ring part 2 on a conductor layer (first conductor layer) 7A, a conductor layer (third conductor layer) 7B, and a conductor layer (second conductor layer) 7C, which are mutually different.

The first split ring part 1 and the second split ring part 2 sandwich the dielectric layers 9A and 9B, and are arranged such that at least a portion is mutually opposing.

A rectangular opening part 5*a* is formed in the first split ring part 1. A rectangular opening part 5*b* similar to the opening part 5*a* is formed in the second split ring part 2. The opening parts 5*a* and 5*b* are respectively formed such that they mutually overlap when viewed from a direction orthogonal to the surface of the dielectric multilayer substrates 7.

A split part (first split part) 6*a* and a split part (second split part) 6*b*, which are slot-shaped, are formed in the first split ring part 1 and the second split ring part 2. The split part 6*a* and the split part 6*b* connect the edges of the opening part 5*a* and the opening part 5*b* on the sides adjacent to the outer edges of the first split ring part 1 and the second split ring part 2, to the outer edges of the first split ring part 1 and the second split ring part 2.

At the periphery of the opening part 5*a* and the opening part 5*b*, a plurality of conductor vias 3 are formed such that they surround the opening part 5*a* and the opening part 5*b* when seen from a top view. The plurality of conductor vias 3 pass through the dielectric layers 9A and 9B and electrically connect the first split ring part 1 and the second split ring part 2.

In this manner, it is made a configuration in which the first split ring part 1 and the second split ring part 2 sandwich the dielectric layers 9A and 9B and are mutually opposed, and are electrically connected by the conductor vias 3. The first split ring part 1 surrounds the opening part 5*a*, and is continuous in an approximate C-shape and has the split part 6*a* formed at a portion in the circumferential direction. The second split ring part 2 surrounds the opening part 5*b*, and is continuous in an approximate C-shape and has the split part 6*b* formed at a portion in the circumferential direction.

One end 4*a* of the power feed line 4 is connected to at least one of the conductor vias 3. The other end 4*b* of the power feed line 4 spans the opening part 5*a* and the opening part 5*b* when seen from a top view and extends to a region that opposes the first split ring part 1 on the opposite side, and is connected to a RF circuit (not shown in the figure).

The first split ring part 1, the second split ring part 2, and the power feed line 4 are generally formed by copper foil. However, the first split ring part 1, the second split ring part 2, and the power feed line 4 may be formed by another material as long as it is conductive. The first split ring part 1, the second split ring part 2, and the power feed line 4 may respectively be the same material, or they may be different materials.

The conductor vias 3 are, in general, formed by plating through-holes that are formed in the dielectric multilayer substrate 7 by a drill. However, the conductor vias 3 may be of any configuration as long as the layers can be electrically connected. For example, the conductor vias 3 can also be configured using laser vias formed by a laser.

In FIG. 1 and FIG. 2, in order to illustrate the structure of the inner layers, the dielectric layers 9A and 9B of the dielectric multilayer substrate 7 are omitted.

According to the antenna 10 of the configuration described above, there is formed a LC series resonant circuit (split ring part resonator) including an inductance generated by an electric current flowing in a ring shape in the first split ring part 1 and the second split ring part 2 along the edge of the opening parts 5*a* and 5*b*, and a capacitance generated in the split parts 6*a* and 6*b*. Consequently, the antenna 10 operates as an antenna near the resonance frequency. The split ring part resonator is supplied with a high-frequency signal from the RF circuit via the power feed line 4.

The resonance frequency of the split ring part resonator can be made a low frequency by increasing the inductance by making the size of the opening parts 5*a* and 5*b* larger and making the current path longer, or by increasing the capacitance by narrowing the spacing of the split parts 6*a* and 6*b*. In particular, in the method of narrowing the spacing of the split parts 6*a* and 6*b*, while the losses become larger due to the electric field being concentrated at the split parts 6*a* and 6*b*, the operating frequency can be made a low frequency without increasing the overall size. Consequently, this method is suitable for miniaturization.

The power feed line 4 forms a transmission line by electrically coupling to the first split ring part 1 in a region where it opposes the first split ring part 1. The characteristic impedance of this transmission line can be designed by the line width of the power feed line 4, or the layer spacing between the first split ring part 1 and the power feed line 4. Consequently, by matching the characteristic impedance of the transmission line with the impedance of the RF circuit, it becomes possible to supply the signal of the RF circuit to the antenna without reflections, and hence this is preferable. However, even in a case where the characteristic impedance of the transmission line is not matched with the impedance of the RF circuit, this does have any effect on the fundamental operation of the present exemplary embodiment.

At least one antenna 10 described above can be provided for an electronic device having a communication function. In such an electronic device, it becomes possible for the whole device to be made smaller since miniaturization of the antenna 10 can be achieved.

The configuration described in the foregoing exemplary embodiment is an example, and it is possible to realize application examples such as those described herein.

In the antenna 10 of the present exemplary embodiment, the impedances of the power feed line 4 and the antenna can be matched by changing the connection position between the power feed line 4 and the split ring part resonator. The connection position of FIG. 1 and FIG. 2 is an example, and the impedances can be adjusted such that they match by connecting the power feed line 4 to another conductor via 3 to thereby change the connection position.

Figure 4:
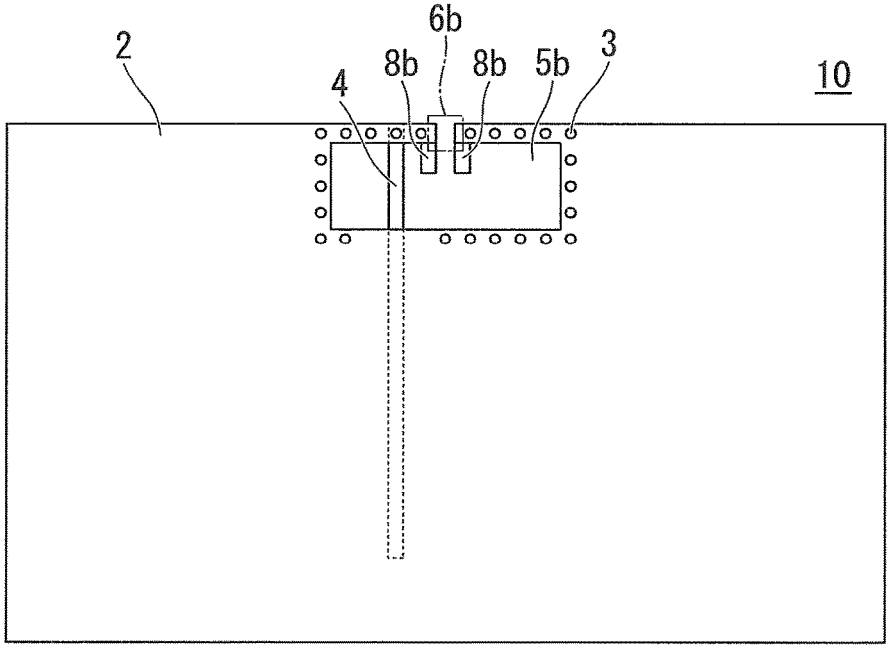
FIG. 4 is a diagram showing a configuration in which an auxiliary conductor pattern is provided for a split part of an antenna according to the first exemplary embodiment of the present invention.

In the foregoing, a configuration in which the capacitance is increased by narrowing the spacing of the split parts 6*a* and 6*b* is described. As an alternative method of increasing the capacitance, for example as shown in FIG. 4, a configuration in which auxiliary conductor patterns 8*a* and 8*b* are provided on the split parts 6*a* and 6*b*, can also be considered. The auxiliary conductor patterns 8*a* and 8*b* include band-shaped conductor layers that extend in a perpendicular direction with respect to the direction in which the split parts 6*a* and 6*b* are opposed. The auxiliary conductor patterns 8*a* and 8*b* increase the opposing conductor area sandwiching the split parts 6*a* and 6*b*. Consequently, it becomes possible to significantly increase the capacitance without making the overall size larger.

Figure 5:
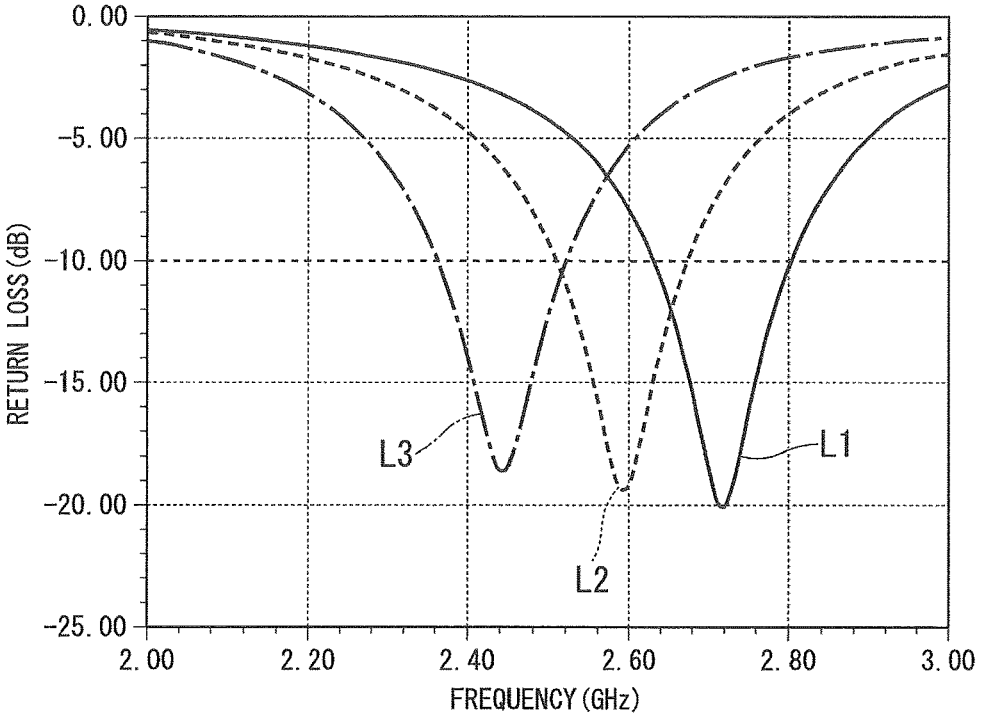
FIG. 5 shows calculation results according to electromagnetic field simulations for the antenna of the present exemplary embodiment in a case where the auxiliary conductor patterns are provided.

FIG. 5 shows calculation results according to electromagnetic field simulations for an antenna of the present exemplary embodiment in a case where the auxiliary conductor patterns are provided. The simulation was performed under the following conditions. The size of the dielectric multilayer substrate was set to 50 mm×30 mm. The size of the split ring part resonator was set to 10 mm×4.5 mm. The spacing of the split parts was set to 0.1 mm. The length L of the auxiliary conductor patterns was varied between length L1 (=1.00 mm), L2 (=1.20 mm), and L3 (=1.45 mm). The horizontal axis of FIG. 5 represents the frequency. The vertical axis of FIG. 5 represents the reflection loss (S11) of the antenna viewed from the power feed line 4. In FIG. 5, the calculation result for the case of an auxiliary conductor pattern length L1 is represented by the solid line. The calculation result for the case of an auxiliary conductor pattern length L2 is represented by the dashed line. The calculation result for the case of an auxiliary conductor pattern length L3 is represented by the alternate long and short dash line. Looking at FIG. 5, it can be understood that as the auxiliary conductor pattern length L becomes larger, the capacitance of the split ring part resonator increases, and the resonance frequency shifts to a low frequency. In the case of the auxiliary conductor pattern length L3 (=1.45 mm), the mean frequency becomes 2.445 GHz, and the operating band of 10 dB and lower becomes 2.36 to 2.52 GHz. Therefore, in this case, it can be confirmed that the frequency band of a wireless LAN can be sufficiently covered.

Figure 6:
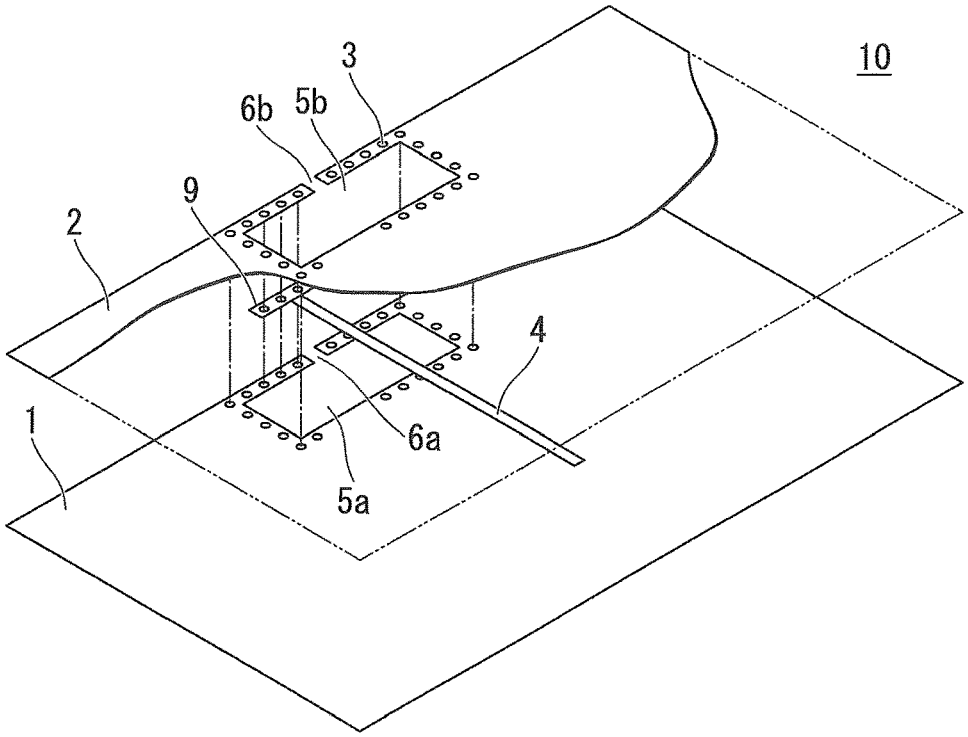
FIG. 6 is a diagram showing an example of a configuration in which, with respect to the antenna according to the first exemplary embodiment of the present invention, a conductor land pattern that connects a plurality of conductor vias is provided, and a power feed line is connected to the conductor land pattern.

The power feed line 4 may be connected to a plurality of conductor vias 3. For example, a configuration as shown in FIG. 6 can be considered. In FIG. 6, a band-shaped conductor land pattern 9 provided so as to connect with the plurality of conductor vias 3, is provided in the same layer as the power feed line 4. The power feed line 4 is connected to the conductor land pattern 9. By configuring it in this manner, the connection position between the power feed line 4 and the split ring part resonator is not limited to the position of the conductor vias 3, and it can be freely designed. Consequently, it becomes possible to match the impedances more easily and with a high accuracy.

In FIG. 1 and FIG. 2, a case is shown in an example where components or wiring are not arranged in the region of the first split ring part 1 or the second split ring part 2. However, it is in no way limited to this configuration. Components such as a LSI or an IC, or wiring, may be arranged in the region of the first split ring part 1 or the second split ring part 2 of any one of the layers of the layers provided for the dielectric multilayer substrate 7. For example, a configuration in which the RF circuit connected to the power feed line 4 is provided in the region of the first split ring part 1 or the second split ring part 2 can be considered. In this case, an aperture provided in the first split ring part 1 or the second split ring part 2 for arranging components or wiring is preferably smaller than the opening parts 5*a* and 5*b*. This is because the electric current of the antenna of the present exemplary embodiment is flowing not only to the split ring part resonator, but also to the first split ring part 1 and the second split ring part 2. Therefore, if an aperture larger than the opening parts 5*a* and 5*b* is present, the aperture behaves as an antenna as a result of the electric current flowing to the aperture periphery, leading to unintended emissions being generated. However, even in a case where, for convenience of the arrangement of the components or the wiring, the aperture cannot be avoided, this does not have any effect on the fundamental operation of the antenna 10 of the present exemplary embodiment.

Furthermore, in FIG. 1 and FIG. 2, a case is shown where the second split ring part 2 is the same shape and size as the first split ring part 1. However, it is in no way limited to this configuration. The second split ring part 2 may be any size or shape as long as it includes the opening part 5*b* when seen from a top view. For example, as shown in FIG. 7, it may be a ring shape formed with an approximately uniform width such that the second split ring part 2 surrounds the opening part 5*b*.

Moreover, it is preferable for the second split ring part 2 to be continuous in a C-shape. However, even if a portion of the second split ring part 2 is not continuous, it does not have any effect on the fundamental operation of the antenna 10 of the present exemplary embodiment. For example, a configuration in which a portion of the second split ring part 2 is not continuous in order to avoid other mounted components can be considered.

Figure 7:
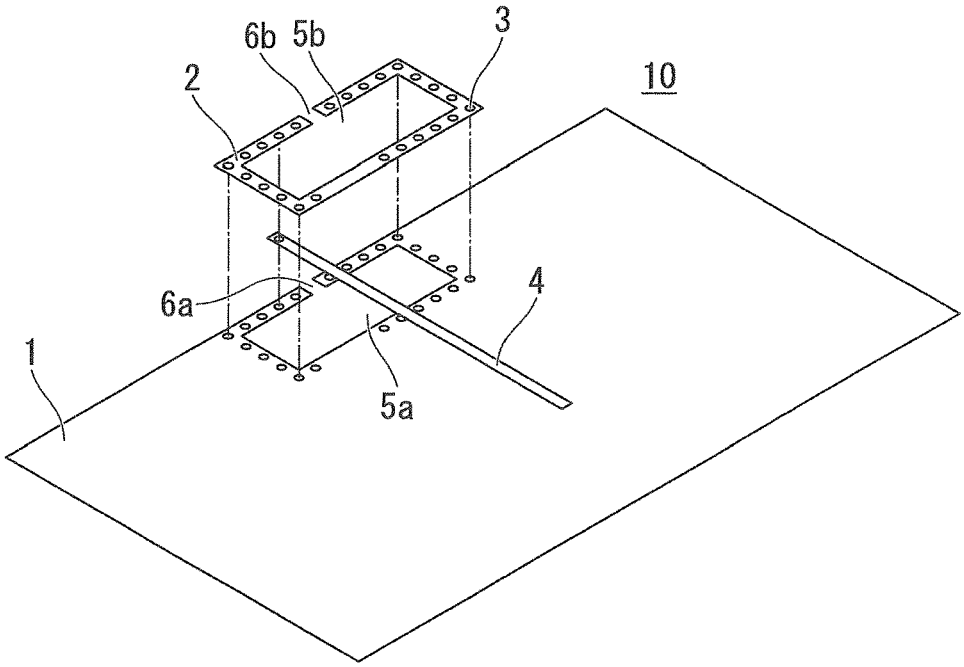
FIG. 7 is a diagram showing an example of a case where a first conductor and a second conductor of the antenna according to the first exemplary embodiment of the present invention are made a rectangular shape.
Figure 8:
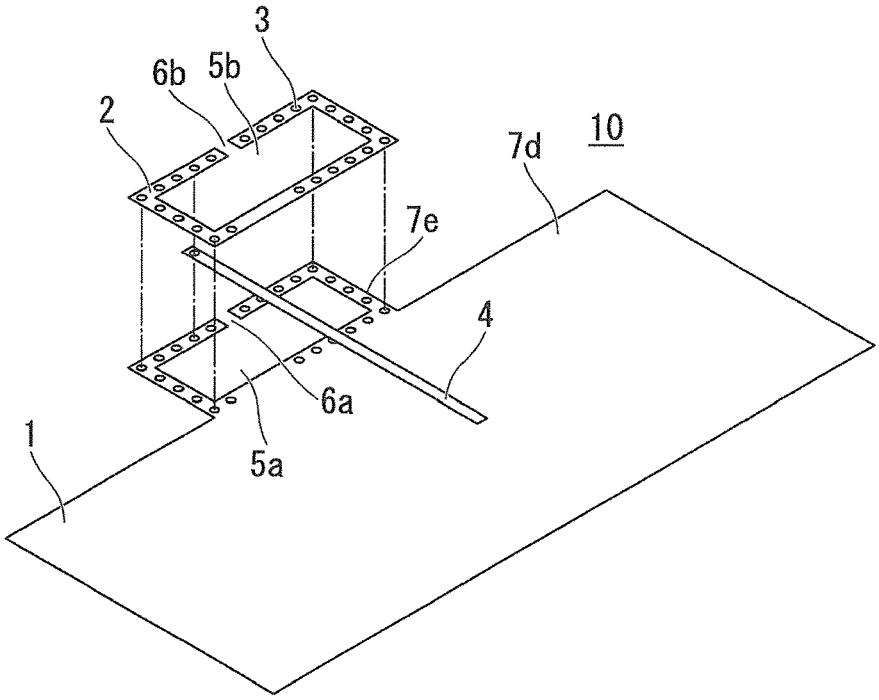
FIG. 8 is a diagram showing an example of a case where the first conductor and the second conductor of the antenna according to the first exemplary embodiment of the present invention are made a T-shape.

In FIG. 7, a case is shown where the first split ring part 1 is a rectangular shape. However, it is in no way limited to this configuration. The first split ring part 1 may be any size or shape as long as it includes the opening part 5*a* when seen from a top view. For example, a configuration such as the one shown in FIG. 8 can be considered. In FIG. 8, the first split ring 1 is formed on a protruding part 7*e* so as to protrude from a rectangular-shaped substrate 7*d*. The opening part 5*a* is arranged in this protruding part 7*e*.

Figure 9:
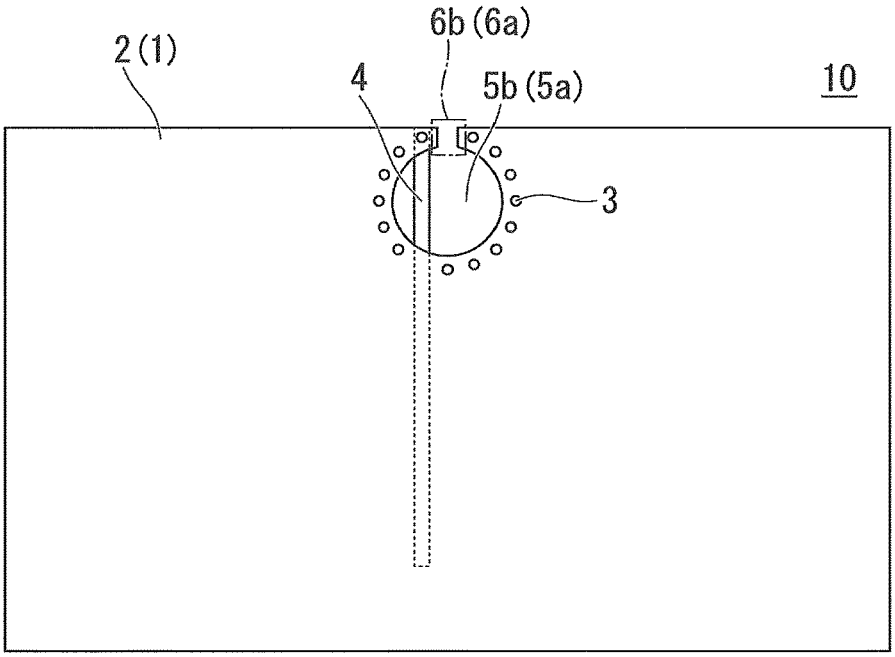
FIG. 9 is a diagram showing an example of a case where the first conductor and the second conductor of the antenna according to the first exemplary embodiment of the present invention are provided with a circular opening part.

In FIG. 1 and FIG. 2, a case is shown in an example where the opening parts 5*a* and 5*b* are rectangular-shaped. However, the shape of the opening parts is not necessarily limited to this. For example, as shown in FIG. 9, a configuration in which circular opening parts 5*a* and 5*b* are provided can be considered. The shape of the opening parts can of course also be another shape.

Figure 10:
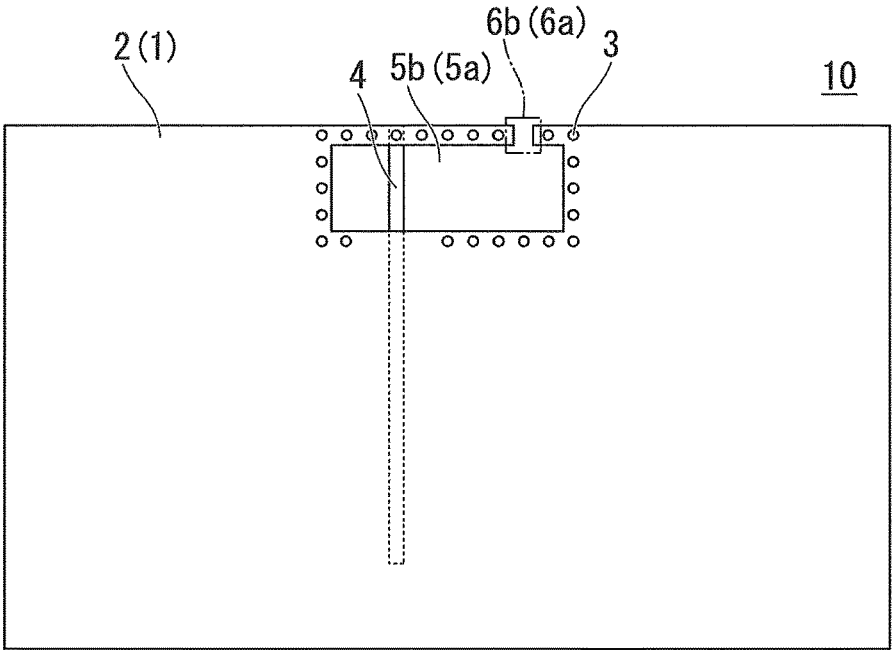
FIG. 10 is a diagram showing an example of a case where the split part of the antenna according to the first exemplary embodiment of the present invention is provided at a position that is displaced from the center.

In FIG. 1 and FIG. 2, an example is shown in which the split parts 6*a* and 6*b* are provided at center portions of the opening parts 5*a* and 5*b* in the longitudinal direction. However, the position of the split parts is not necessarily limited to this. For example, as shown in FIG. 10, they may be provided at a position that is offset from the center portion in the longitudinal direction. A configuration in which split parts are provided at two positions can also be considered.

Figure 11:
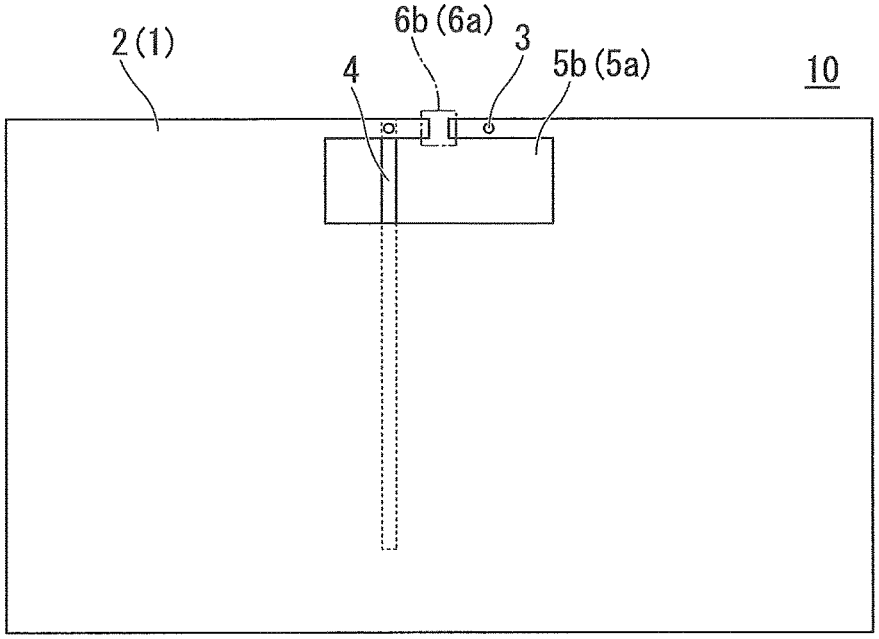
FIG. 11 is a diagram showing an example of a case where conductor vias are singly provided on both sides sandwiching the split part of the antenna according to the first exemplary embodiment of the present invention.

In FIG. 1 and FIG. 2, an example is shown in which the conductor vias 3 are arranged such that they surround the opening part 5*a* and the opening part 5*b* when seen from a top view. However, the arrangement of the conductor vias 3 is in no way limited to this as long as a plurality of conductor vias 3 are provided at the periphery of the opening parts. For example, as shown in FIG. 11, it may also be a configuration in which the conductor vias 3 are singly provided on both sides sandwiching the split part.

The dielectric multilayer substrate 7 may be configured by any type of material and formed by any type of process as long as it is a multilayer substrate.

For example, the dielectric multilayer substrate 7 may be a printed board using a glass epoxy resin. The dielectric multilayer substrate 7 may be an interposer substrate such as a LSI. The dielectric multilayer substrate 7 may be a module substrate using a ceramic material such as LTCC. The dielectric multilayer substrate 7 may of course be a semiconductor substrate such as silicon.

Here, a case where the antenna 10 of the present exemplary embodiment is formed in the dielectric multilayer substrate 7 is described as an example. However, as long as the respective components made from a conductor are arranged and connected as mentioned above, it is not required for the space between the respective components to necessarily be filled with a dielectric material. For example, a configuration in which the respective components are manufactured from sheet metal and the interval between the respective components is partially supported by a dielectric material support member can also be considered. In this case, the sections other than the dielectric material support member are hollow, and hence the dielectric loss is reduced and the radiation efficiency of the antenna can be improved.

Second Exemplary Embodiment

Figure 12:
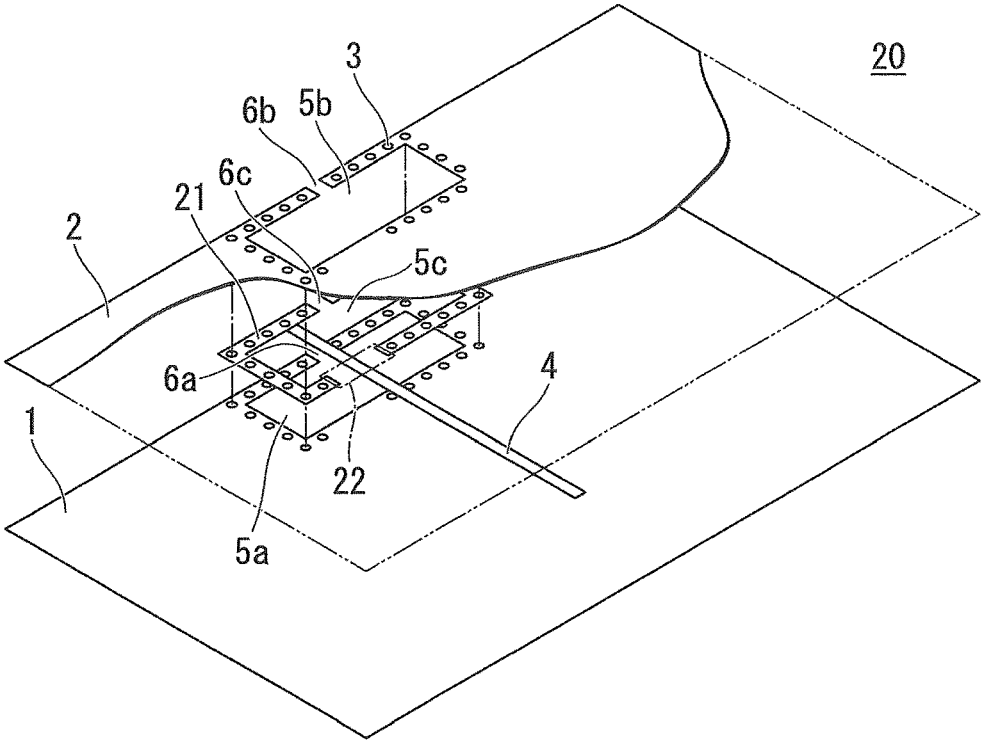
FIG. 12 is a perspective view of an antenna according to a second exemplary embodiment of the present invention.

FIG. 12 is a perspective view of an antenna 20 according to a second exemplary embodiment of the present invention. As shown in FIG. 12, the antenna 20 according to the present exemplary embodiment is the same as the antenna 10 of the first exemplary embodiment, with the exception of the following points.

The antenna 20 shown in FIG. 12 includes a third split ring part (second split ring part) 21 in the same layer as the power feed line 4. The third split ring part 21 is arranged such that at least a portion thereof is mutually opposing the first split ring part 1 and the second split ring part 2.

The third split ring part 21 is such that a rectangular-shaped opening part 5*c* is formed in the same manner as the first split ring part 1 and the second split ring part 2. The opening parts 5*a*, 5*b*, and 5*c* are arranged such that they respectively overlap when seen from a top view.

A slot-shaped split part (second split part) 6*c* is opening partly formed such that it overlaps with the split parts 6*a* and 6*b* when seen from a top view. The opening part 5*c* is joined with the outer edge of the third split ring part 21 by means of the split part 6*c*.

The third split ring part 21 is provided with a clearance 22 in the region to which the power feed line 4 extends. The third split ring part 21 and the power feed line 4 are insulated by means of the clearance 22.

The conductor vias 3 are arranged such that they surround the opening part 5*a*, 5*b*, and 5*c* when seen from a top view. The conductor vias 3 electrically connect the first split ring part 1, the second split ring part 2, and the third split ring part 21. In the antenna 20 of the present second exemplary embodiment, there is formed a LC series resonant circuit (split ring part resonator) including an inductance generated by an electric current flowing in a ring shape along the edge of the opening parts 5*a*, 5*b*, and 5*c*, and a capacitance generated in the split parts 6*a*, 6*b*, and 6*c*. Consequently, it operates as an antenna near the resonance frequency.

The power feed line 4 is connected to the third split ring part 21. Consequently, the power feed line 4 is able to supply a high-frequency signal from the RF circuit to the split ring part resonator.

The present exemplary embodiment represents a configuration in which the capacitances generated at the three split parts 6*a*, 6*b*, and 6*c* are connected in parallel. Consequently, in the present exemplary embodiment, the capacitance can be increased from the first exemplary embodiment by the amount of the split part 6*c*. Therefore, compared to the antenna 10 of the first exemplary embodiment, the antenna 20 of the present exemplary embodiment is able to make the resonance frequency a low frequency.

In FIG. 12, a case is shown where the third split ring part 21 is a ring shape close to the size of the opening part 5*c*. However, the third split ring part 21 may be any size or any shape as long as it includes the opening part 5*c* when seen from a top view. For example, the third split ring part 21 may be the same shape and size as the first split ring part 1.

Figure 13:
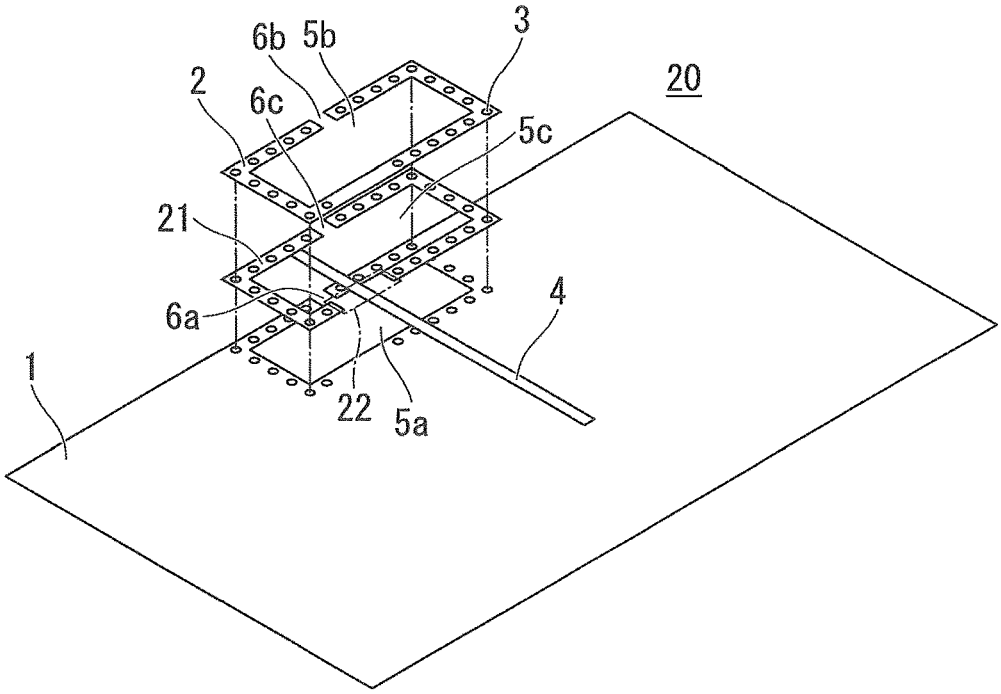
FIG. 13 is a diagram showing an example of another shape of a second conductor according to the second exemplary embodiment.

In FIG. 12, although a case is shown where the second split ring part 2 is the same shape and size as the first split ring part 1, the second split ring part 2 may be any size or any shape as long as it includes the opening part 5*b* when seen from a top view. For example, as shown in FIG. 13, it may be a ring shape formed with an approximately uniform width such that the second split ring part 2 surrounds the opening part 5*b*.

Figure 14:
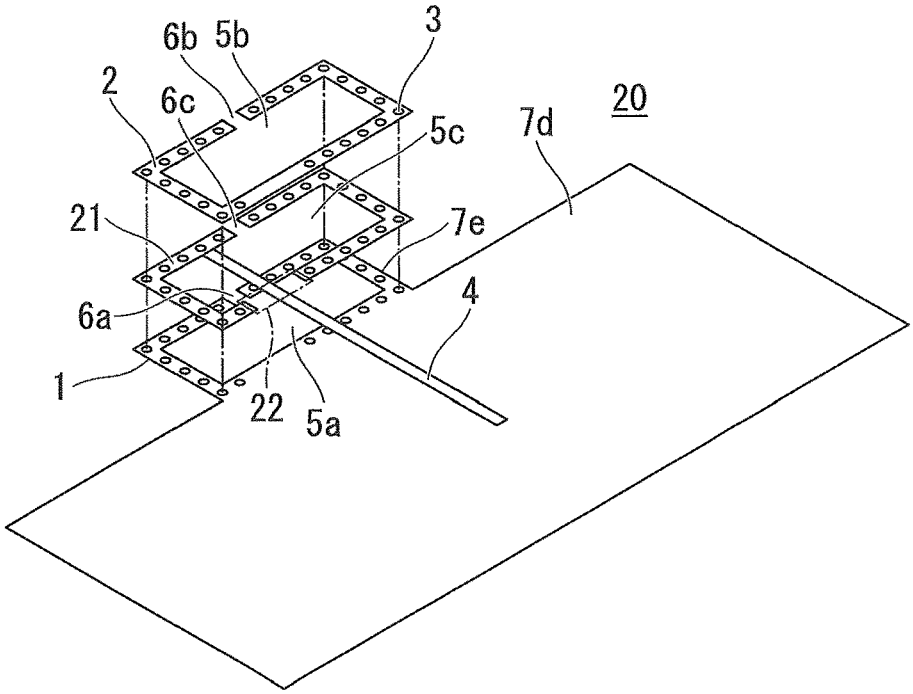
FIG. 14 is a diagram showing an example of another shape of a first conductor according to the second exemplary embodiment.

In FIG. 12, a case is shown where the first split ring part 1 is a rectangular shape. However, the first split ring part 1 may be any size or any shape as long as it includes the opening part 5*a* when seen from a top view. For example, a configuration such as the one shown in FIG. 14 can be considered. In FIG. 14, the first split ring 1 is formed on a protruding part 7*e* so as to protrude from a rectangular-shaped substrate 7*d*. The opening part 5*a* is arranged in this protruding part 7*e*.

In FIG. 12, a case is shown where the third split ring part 21 is provided only to the same layer as the power feed line 4. However, it is in no way limited to this configuration. A plurality of third split ring parts 21 may be provided for the plurality of layers between the first split ring part 1 and the second split ring part 2, including the same layer as the power feed line 4.

In this case, the power feed line 4 is to be connected to the third split ring part 21 provided for the same layer as the power feed line 4.

Third Exemplary Embodiment

Figure 15:
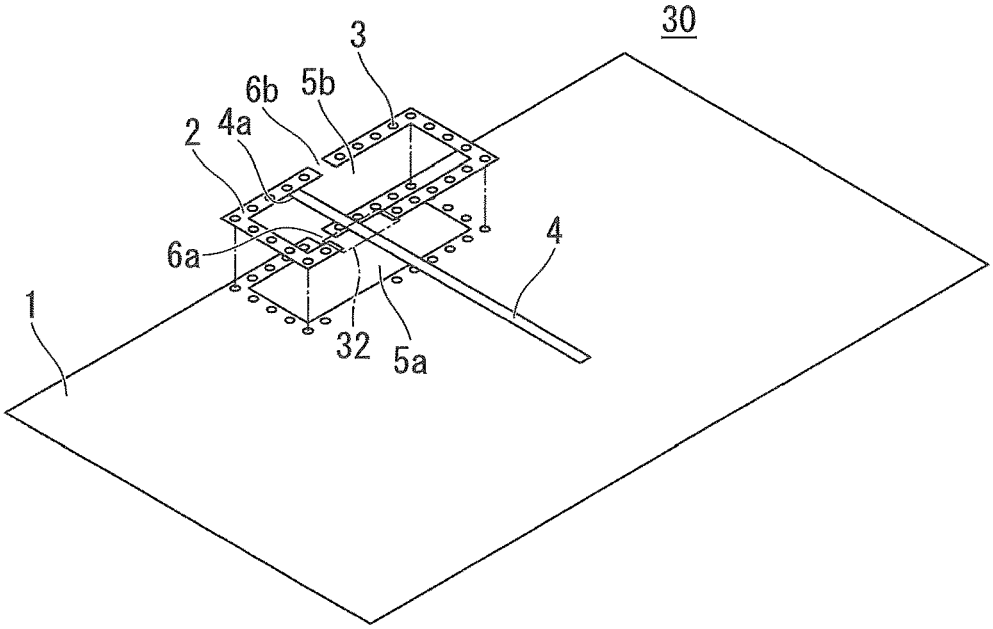
FIG. 15 is a perspective view of an antenna according to a third exemplary embodiment of the present invention.

FIG. 15 is a perspective view of an antenna 30 according to a third exemplary embodiment of the present invention.

As shown in FIG. 15, the antenna 30 according to the present exemplary embodiment is the same as the antenna 10 of the first exemplary embodiment, with the exception of the following points.

In the antenna 30 shown in FIG. 15, the power feed line 4 is arranged in the same layer as the second split ring part 2. One end 4*a* of the power feed line 4 is connected to the edge of the opening part 5*b* of the second split ring part 2. The second split ring part 2 is provided with a clearance 32 in the region to which the power feed line 4 extends. The second split ring part 2 and the power feed line 4 are insulated by means of the clearance 32. By being configured as described above, by means of the power feed line 4, it is possible to supply a high-frequency signal from the RF circuit to the split ring part resonator.

In FIG. 15, a case is shown where second split ring part 2 is a ring shape formed with an approximately uniform width such that it surrounds the opening part 5*b*. However, the second split ring part 2 may be any shape as long as it contains the opening part 5*b* when seen from a top view.

Figure 16:
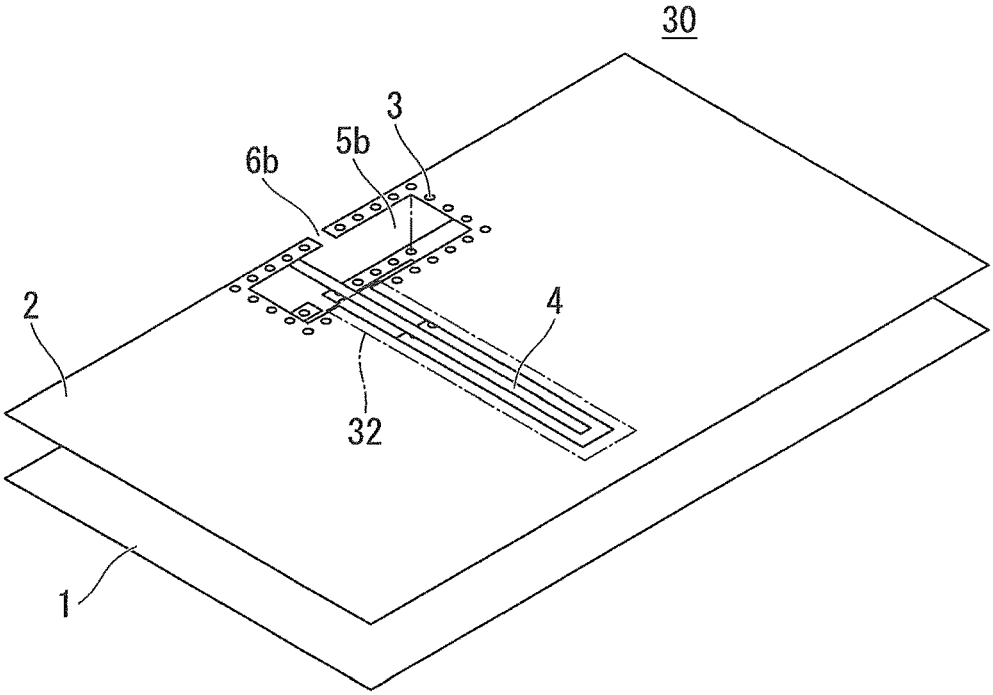
FIG. 16 is a perspective view of an antenna according to a modified example of the third exemplary embodiment of the present invention.

For example, as shown in FIG. 16, the second split ring part 2 may be the same shape and size as the first split ring part 1. In the case of FIG. 16, in the same manner as the case of FIG. 15, the second split ring part 2 is provided with a clearance 32 in the region to which the power feed line 4 extends. The second split ring part 2 and the power feed line 4 are insulated by means of the clearance 32. By being configured as described above, by means of the power feed line 4, it is possible to supply a high-frequency signal from the RF circuit to the split ring part resonator.

In the case of FIG. 16, the power feed line 4 Ruins a transmission line by electrically coupling to the first split ring part 1 and the second split ring part 2 in a region where it opposes the first split ring part 1. The characteristic impedance of this transmission line can be designed by the line width of the power feed line 4, the layer spacing between the first split ring part 1 and the power feed line 4, or the spacing between the second split ring part 2 and the power feed line 4. Consequently, in the case of FIG. 16, in exactly the same manner as in FIG. 15, by matching the characteristic impedance of the transmission line with the impedance of the RF circuit, it becomes possible to supply the signal of the RF circuit to the antenna without reflections.

According to the present exemplary embodiment, since the antenna can be configured by two layers, the dielectric multilayer substrate 7 can be made thinner in comparison to the antenna 10 of the first exemplary embodiment.

Fourth Exemplary Embodiment

Figure 17:
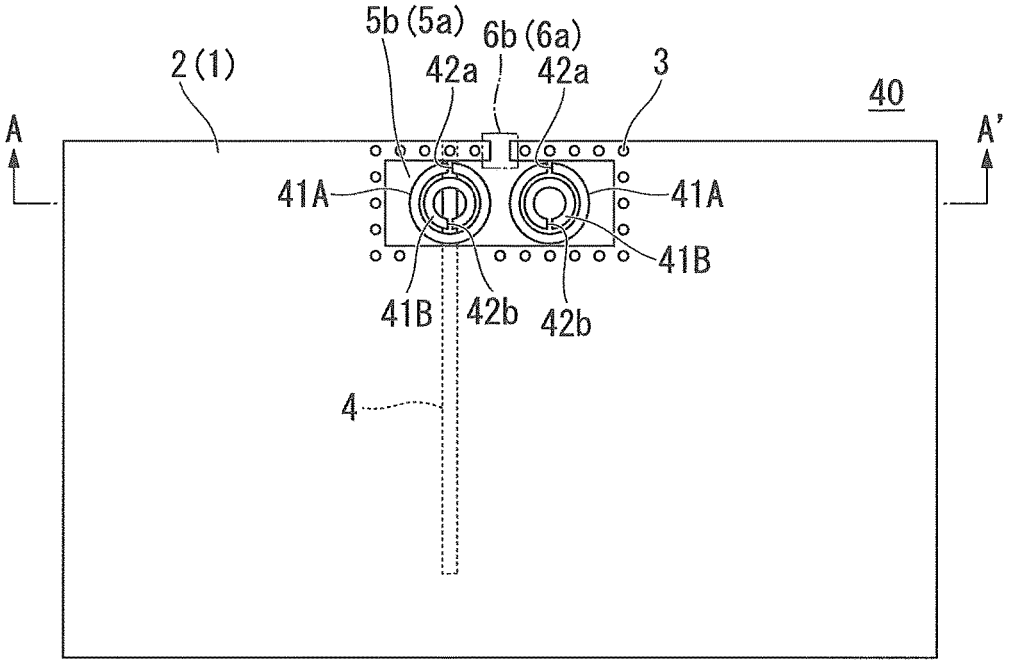
FIG. 17 is a perspective view of an antenna according to a fourth exemplary embodiment of the present invention.
Figure 18:
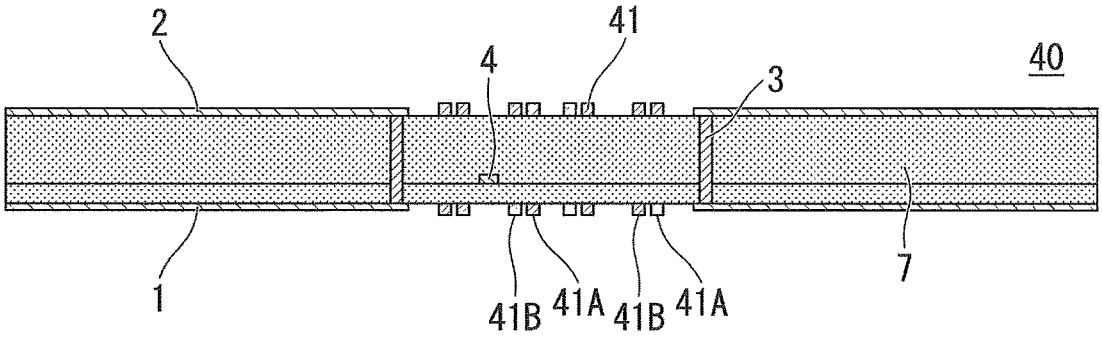
FIG. 18 is a cross-sectional view along line A-A' in FIG. 17.

FIG. 17 is a top view of an antenna 40 according to a fourth exemplary embodiment of the present invention. FIG. 18 is a cross-sectional view along line A-A' of the top view of the antenna 40 of FIG. 17. As shown in FIG. 17 and FIG. 18, the antenna 40 according to the present exemplary embodiment is the same as the antenna 10 of the first exemplary embodiment, with the exception of the following points.

In the antenna 40 shown in FIG. 17 and FIG. 18, split ring resonators 41 are arranged in each of the interior of the opening part 5*a* of the same layer as the first split ring part 1 and the interior of the opening part 5*b* of the same layer as the second split ring part 2. The split ring resonator 41 has a ring-shaped conductor pattern 41A, and a ring-shaped conductor pattern 41B arranged in the interior of the conductor pattern 41A. The conductor pattern 41A has a split. The conductor pattern 41B has a split in the same manner as the conductor pattern 41A, and is somewhat smaller than the conductor pattern 41A. The splits 42*a* and 42*b* provided in the respective rings on the outside and the inside are configured such that they mutually face opposite sides.

The split ring resonator 41 interacts with a magnetic flux that passes through the opening parts 5*a* and 5*b*, and the effective magnetic permeability of the antenna can be controlled. In particular, since the effective magnetic permeability can be made a large value near the resonance frequency of the split ring resonator 41, the operating frequency of the antenna 40 can be made a low frequency.

Figure 19A:
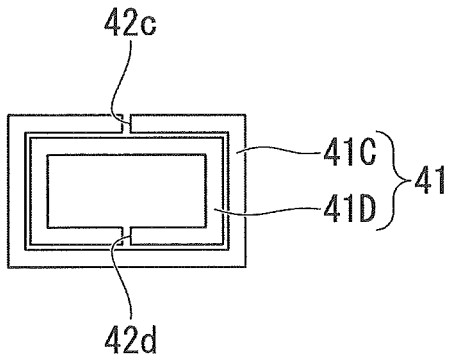
FIG. 19A is a diagram showing an example of another shape of a split ring part resonator according to the fourth exemplary embodiment.
Figure 19B:
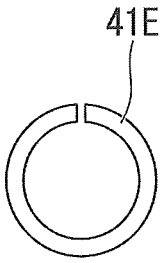
FIG. 19B is a diagram showing an example of another shape of the split ring part resonator according to the fourth exemplary embodiment.
Figure 19C:
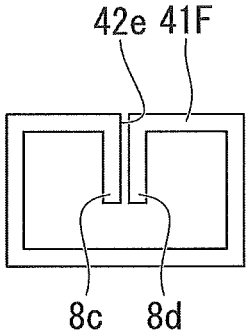
FIG. 19C is a diagram showing an example of another shape of the split ring part resonator according to the fourth exemplary embodiment.

The split ring resonator 41 is not necessarily limited to the shape of FIG. 17. For example, similar effect can be obtained using the split ring resonators shown in FIG. 19A to 19C. FIG. 19A represents an example of a configuration in which rectangular-type split ring resonators 41C and 41D are doubly provided on the inside and the outside, and the split parts 42*c* and 42*d* are formed such that they mutually face opposite sides. FIG. 19B represents an example of a single C-shape split ring resonator 41E. FIG. 19C represents an example of a single split ring resonator 41F. In the split ring resonator 41F, band-shaped auxiliary conductor patterns 8*c* and 8*d* are formed on both sides thereof which sandwich the split part 42*e*. As a result of this configuration, the capacitance at the split part 42*e* can be increased, and hence a larger effective magnetic permeability can be achieved.

Furthermore, in FIG. 17 and FIG. 18, an example is shown where two split ring resonators 41 are arranged at each of the opening parts 5*a* and 5*b*. However, one split ring resonator 41 may be arranged at each of the opening parts 5*a* and 5*b*, or three or more may be arranged at each. In FIG. 18, an example is shown where the split ring resonator 41 is arranged in the same layer as the first split ring part 1 and the second split ring part 2. However, the split ring resonator 41 may of course be provided for another layer as long as it is positioned in the interior of the opening parts 5*a* and 5*b* when seen from a top view. However, in a case where the split ring resonator 41 is provided for the same layer as the power feed line 4, caution is needed in the arrangement so that the split ring resonator 41 and the power feed line 4 do not make contact.

Fifth Exemplary Embodiment

Figure 20:
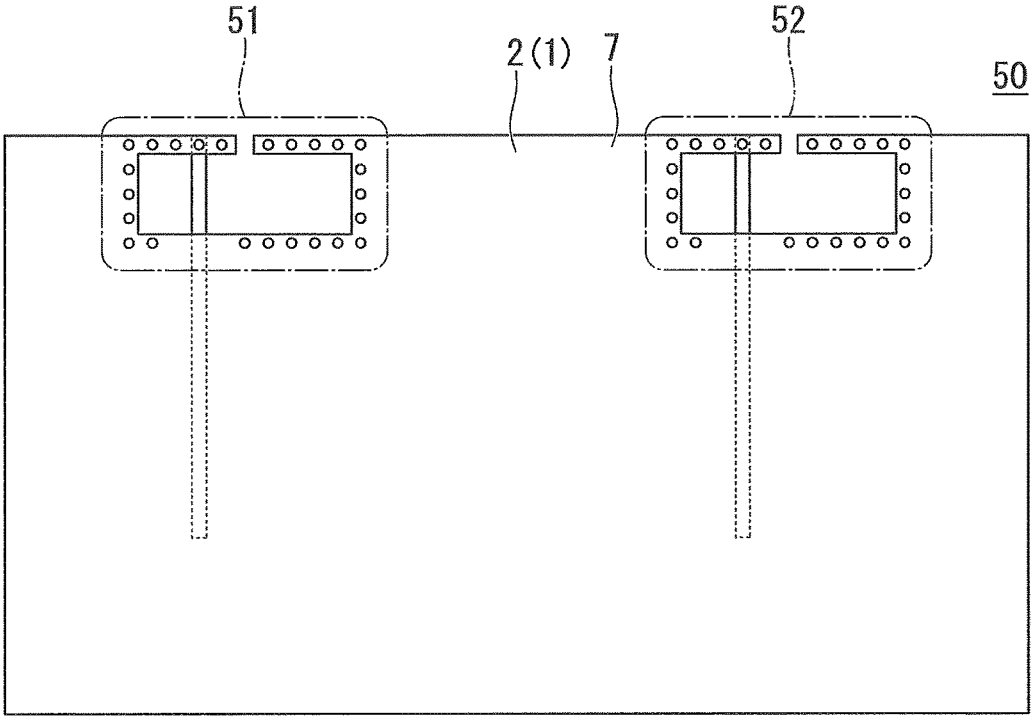
FIG. 20 is a top view of an antenna according to a fifth exemplary embodiment of the present invention.

FIG. 20 is a top view of an antenna 50 according to a fifth exemplary embodiment of the present invention. As shown in FIG. 20, the antenna 50 according to the present exemplary embodiment is based on the first exemplary embodiment, and is characterized by including two antennas according to the first exemplary embodiment.

The antenna 50 of the present exemplary embodiment includes a first antenna 51 and a second antenna 52 at the first split ring part 1 and the second split ring part 2 of the dielectric multilayer substrate 7. As a result of such a configuration, it can be used in communication methods that require a plurality of antennas such as MIMO (Multiple Input Multiple Output) for example.

Figure 21:
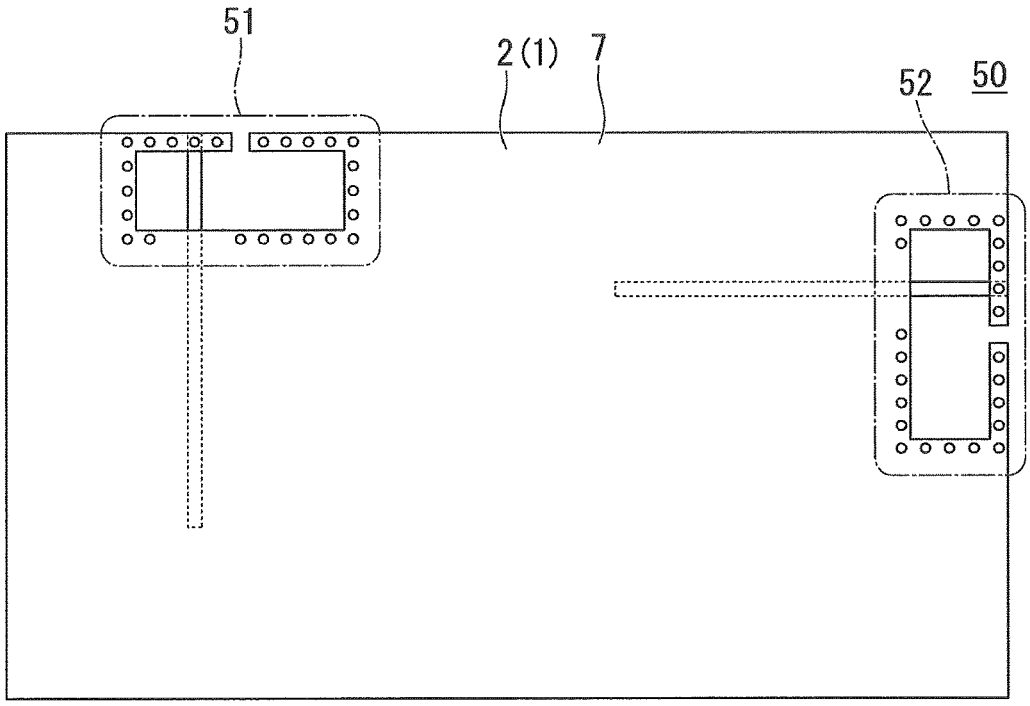
FIG. 21 is a diagram showing, in the fifth exemplary embodiment, an example where the orientations of a first and a second antenna are made orthogonal.

In order to obtain a high throughput with MIMO, it is known that a low correlation coefficient between the antennas is desirable. Consequently, as shown in FIG. 21, a configuration in which the correlation coefficient between the antennas is reduced by making the orientation of the first and the second antennas orthogonal can be considered.

Here, a case based on the first exemplary embodiment is described as an example. However, a configuration based on the other exemplary embodiments can of course also be considered.

Here, a case where two antennas are provided is described as an example. However, a configuration in which more than two antennas are provided can of course also be considered.

Sixth Exemplary Embodiment

Figure 22:
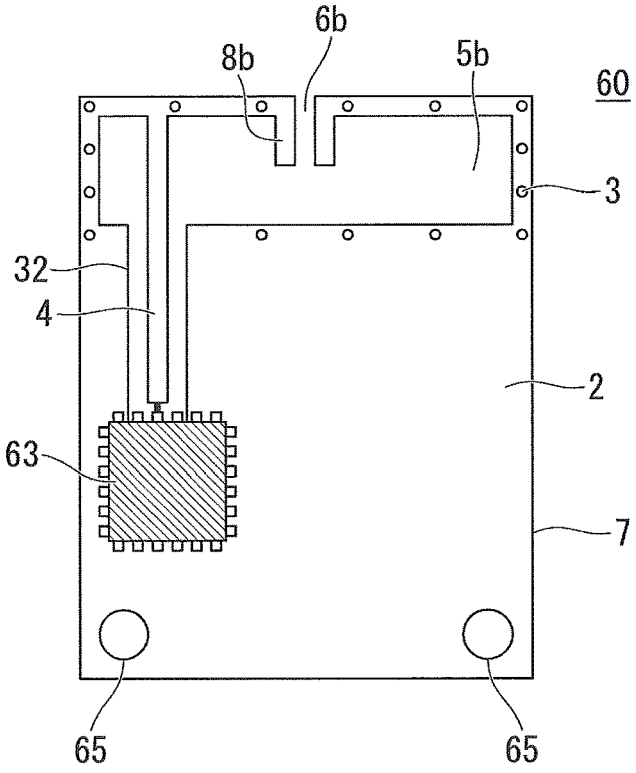
FIG. 22 is a top view of an antenna according to a sixth exemplary embodiment of the present invention.
Figure 23:
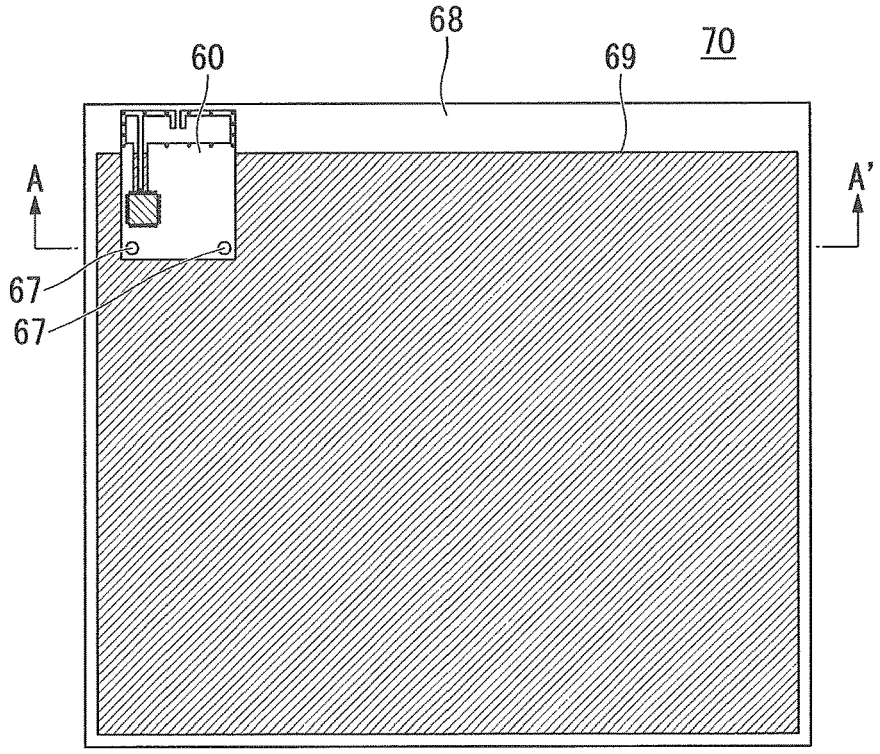
FIG. 23 is a top view showing an example of an electronic device in which an antenna according to the present exemplary embodiment is connected to a parent substrate.
Figure 24:
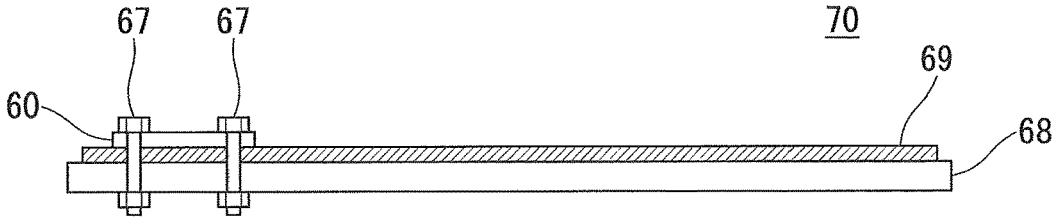
FIG. 24 is a cross-sectional view along line A-A' in FIG. 23.

FIG. 22 is a top view of an antenna 60 according to a sixth exemplary embodiment of the present invention. FIG. 23 is a top view showing an example of an electronic device 70 in which the antenna 60 of the present exemplary embodiment is connected to a parent substrate 68. FIG. 24 is a cross-sectional view of the electronic device 70 along line A-A' in FIG. 23. As shown in FIG. 22, the antenna 60 according to the present exemplary embodiment is the same as the antenna 30 according to the third exemplary embodiment, with the exception of the following points.

That is to say, the antenna 60 of the present exemplary embodiment includes an RF circuit 63 in the region of the second split ring part 2. It is configured such that the signals from the RF circuit 63 are input to the power feed line 4, and functions as a wireless module. The parent substrate 68 has functions other than wireless communication. Fixing screw holes 65 are provided in order to fix the antenna 60 to this parent substrate 68, and also to make an electrical connection between the antenna 60 and the parent substrate 68. The fixing screw holes 65 are provided in an area near an opposite side to the side where the opening part 5*a*, 5*b* of at least one of the first split ring part 1 and the second split ring part 2 is provided.

In the electronic device 70 shown in FIG. 23 and FIG. 24, conductive screws 67 are passed through the fixing screw holes 65, and through screw holes provided in the region of a ground plane 69 of the parent substrate 68, to thereby fix the antenna 60 to the parent substrate 68.

The fixing screw holes 65 and the conductive screws 67 function as electrically connecting parts, thereby electrically connecting at least one of the first split ring part 1 and the second split ring part 2 of the antenna 60 and the ground plane 69 of the parent substrate 68. Consequently, it becomes possible to make the electric potential of both elements the same.

For example, in the case of a common substrate antenna such as a reverse F antenna, an antenna current flows to the whole ground plane of the antenna. Therefore, when the ground plane of the antenna and the ground plane of the parent substrate are electrically connected, the path of the antenna current changes, and hence the antenna characteristics become highly variable. In contrast, in the antenna 60 of the present exemplary embodiment, the antenna current is concentrated at the periphery of the opening parts 5*a* and 5*b*, and the antenna current at the position of the fixing screw holes 65 is comparatively small. Consequently, even in a case when it is connected to the parent substrate 68, the effect on the antenna current is small, and it becomes possible to suppress changes to the antenna characteristics.

Figure 25:
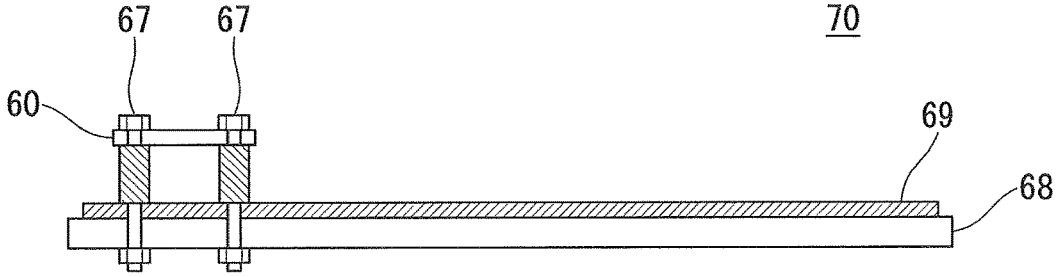
FIG. 25 is a cross-sectional view of an electronic device according to a first modified example of the sixth exemplary embodiment of the present invention.

In FIG. 24, a case is shown where the antenna 60 is installed without providing a spacing with the parent substrate 68. However, for example as shown in FIG. 25, a spacing may be provided between the antenna 60 and the parent substrate 68 by inserting a spacer between the antenna 60 and the parent substrate 68. In this case, the antenna 60 can be separated from the ground plane 69 of the parent substrate 68, which is a conductive material. Consequently, degradations in the characteristics of the antenna can be suppressed. However, even in a case where a spacing is not provided, it does not have any effect on the fundamental operation of the antenna 60 of the present exemplary embodiment.

Here, a case where two fixing screw holes 65 are provided is described as an example. However, there may be one fixing screw hole 65, or three or more.

Figure 26:
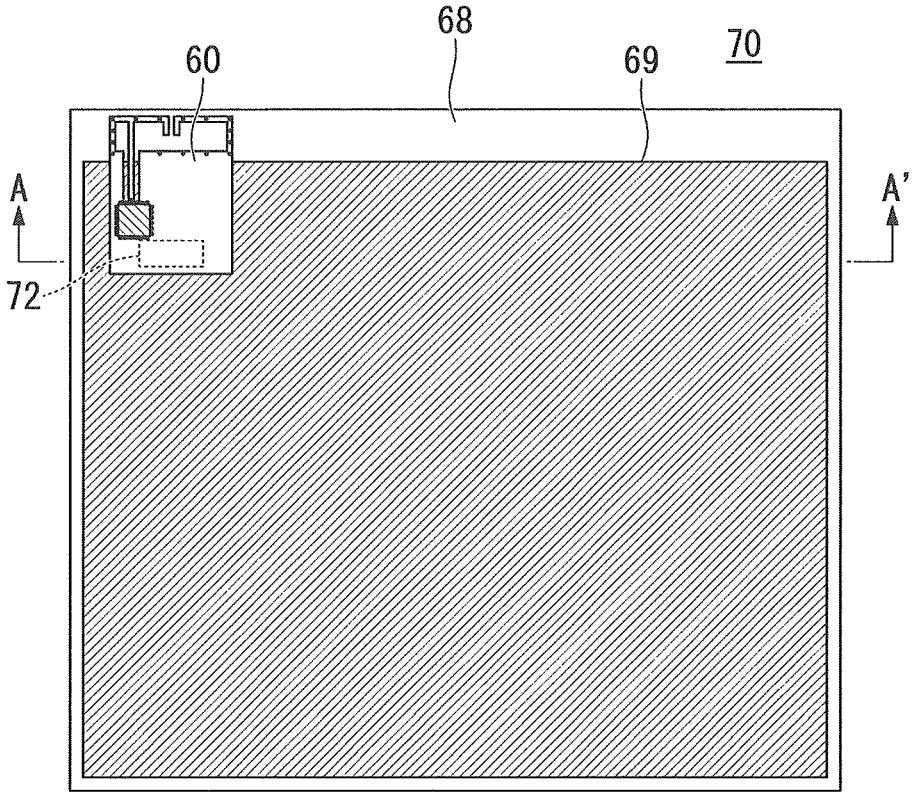
FIG. 26 is a top view of an electronic device according to a second modified example of the sixth exemplary embodiment of the present invention.
Figure 27:
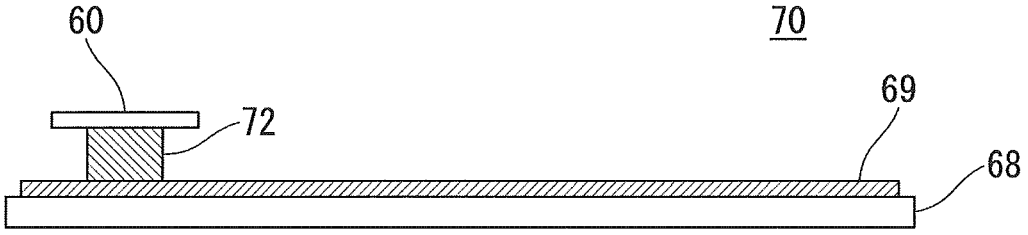
FIG. 27 is a cross-sectional view of the electronic device according to the second modified example of the sixth exemplary embodiment of the present invention.

Here, a case where the fixing screw holes 65 and the conductive screws 67 serve as electrically connecting parts is described as an example. However, the configuration of the electrically connecting parts is not necessarily limited to this, as long as they are provided in an area near an opposite side to the side where the opening part 5*a*, 5*b* of at least one of the first split ring part 1 and the second split ring part 2 is provided. For example, as shown in FIG. 26 and FIG. 27, a configuration of the electrically connecting parts can also be considered in which, in that region, a connector 72 that is connected to at least one of the first split ring part 1 or the second split ring part 2 is provided, and connection with the ground plane 69 of the parent substrate 68 is made via the connector 72.

In FIG. 23, a case is shown where the antenna 60 is connected to the corner of the parent substrate 68. However, the connection position of the antenna 60 is not necessarily limited to this position. For example, the antenna 60 may of course also be connected near the center portion of the parent substrate 68.

In FIG. 23, a case is shown where just one antenna 60 is connected to the parent substrate 68. However, a configuration in which a plurality of antennas 60 are connected to the parent substrate 68 can of course also be considered.

Here, a case based on the third exemplary embodiment is described as an example. However, a configuration based on the other exemplary embodiments can of course also be considered.

Seventh Exemplary Embodiment

Figure 28:
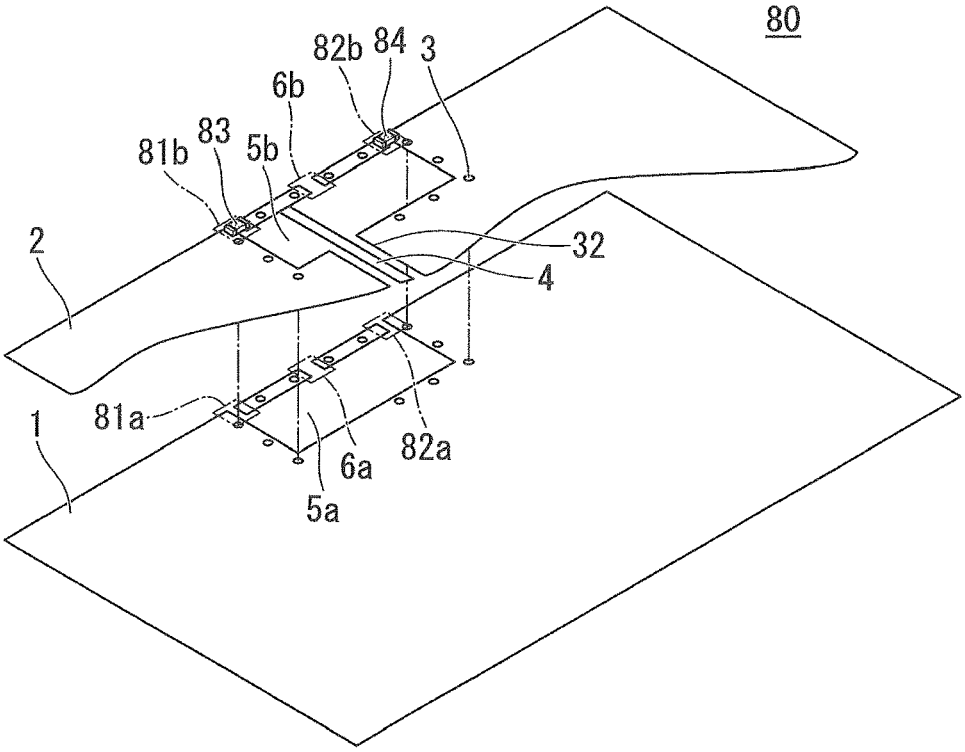
FIG. 28 is a perspective view of an antenna according to a seventh exemplary embodiment of the present invention.
Figure 29:
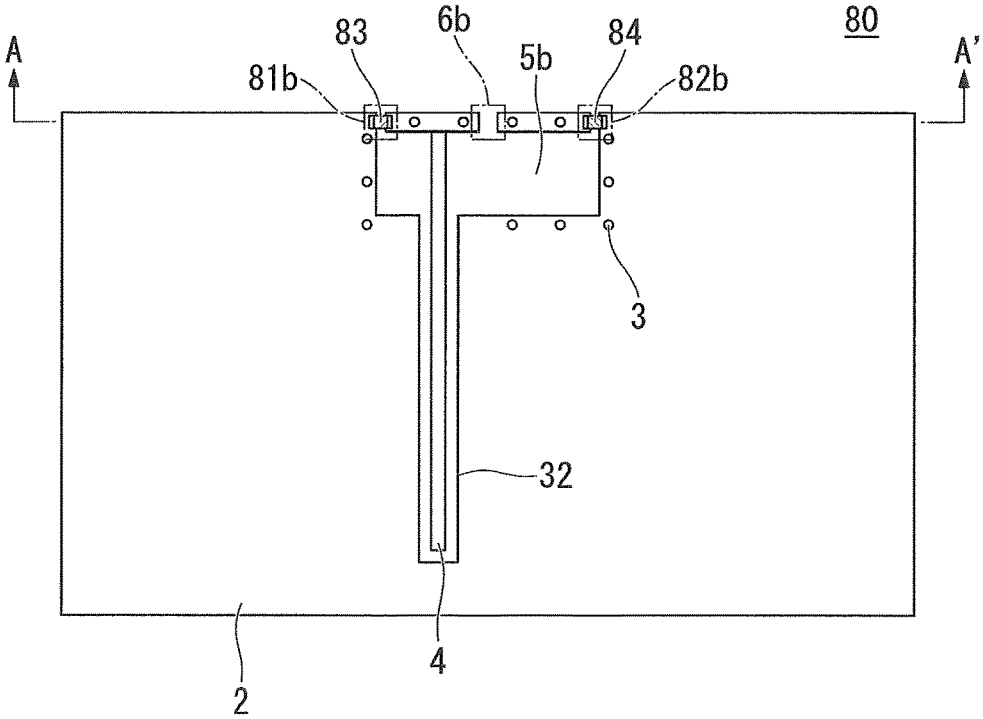
FIG. 29 is a top view of the antenna according to the seventh exemplary embodiment of the present invention.
Figure 30:
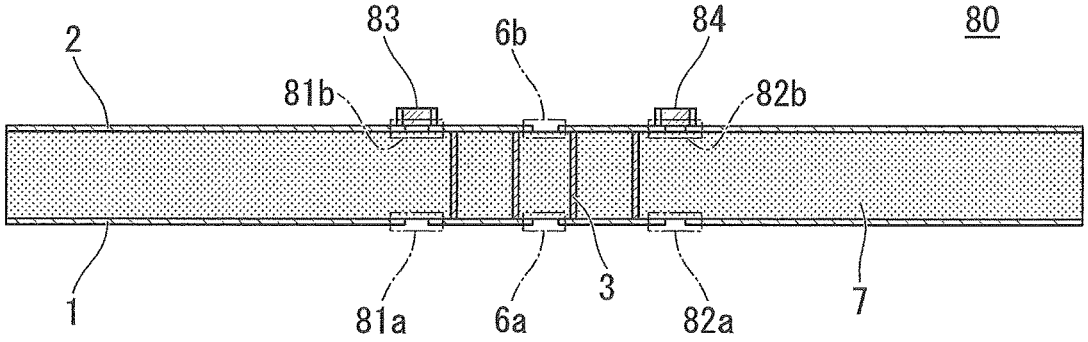
FIG. 30 is a cross-sectional view along line A-A' in FIG. 29.

FIG. 28 is a perspective view of an antenna 80 according to a seventh exemplary embodiment of the present invention. FIG. 29 is a top view of the antenna 80. FIG. 30 is a cross-sectional view along line A-A' in FIG. 29. As shown from FIG. 28 to FIG. 30, the antenna 80 according to the present exemplary embodiment is the same as the antenna 30 according to the third exemplary embodiment, with the exception of the following points.

The first split ring part 1 and the second split ring part 2 of the antenna 80 of the present exemplary embodiment have a first spacing 81*a* and a second spacing 81*b* formed such that they overlap with each other in plan view. In the same manner, the first split ring part 1 and the second split ring part 2 have a second first spacing 82*a* and a second second spacing 82*b* formed such that they overlap with each other in plan view.

A first chip component 83 is connected to the second spacing 81*b* so as to connect to both sides of the second split ring part 2, which is divided by the second spacing 81*b*. In the same manner, a second chip component 84 is connected to the second second spacing 82*b* so as to connect to both sides of the second split ring part 2, which is divided by the second second spacing 82*b*.

In the antenna 80 of the present exemplary embodiment, the impedances formed by the first chip component 83 and the second chip component 84 are further added in series to the split ring resonator of the antenna 30 of the third exemplary embodiment. Consequently, it becomes possible to change the resonance frequency of the split ring resonator.

For example, in a case where chip inductors are used as the first chip component 83 and the second chip component 84, the inductances are added in series to the split ring resonator. Consequently, the resonance frequency can be made a low frequency according to the values of the inductances.

For example, in a case where chip capacitors are used as the first chip component 83 and the second chip component 84, the capacitances are added in series to the split ring resonator. Consequently, the resonance frequency can be made a high frequency according to the values of the capacitances. Therefore, by appropriately selecting the impedances of the first chip component 83 and the second chip component 84, it becomes possible to easily adjust the operating frequency of the antenna 80.

If zero ohm resistances are used as the first chip component 83 and the second chip component 84, a series impedance is not added to the split ring resonator. As a result, the resonance frequency of the split ring resonator does not change. Consequently, in a case where it is not necessary to adjust the operating frequency of the antenna 80, zero ohm resistances may be selected as the first chip component 83 and the second chip component 84.

Here, a case where the first chip component 83 is connected to the second spacing 81*b* is described as an example. However, the first chip component 83 may be connected to one of the first spacing 81*a* and the second spacing 81*b*, or to both.

In the same manner, in FIG. 30, a case where the second chip component 84 is connected to the second second spacing 82*b* is described as an example. However, the second chip component 84 may be connected to one of the second first spacing 82*a* and the second second spacing 82*b*, or to both.

Figure 31:
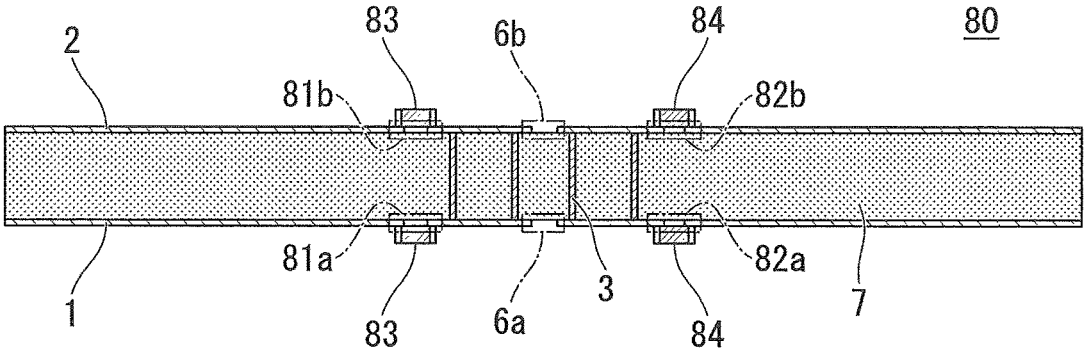
FIG. 31 is a cross-sectional view of an antenna according to a first modified example of the seventh exemplary embodiment of the present invention.

For example, as shown in FIG. 31, a configuration in which the first chip components 83 are each singly connected to both the first spacing 81*a* and the second spacing 81*b*, and the second chip components 84 are each singly connected to both the second first spacing 82*a* and the second second spacing 82*b* can also be considered.

Figure 32:
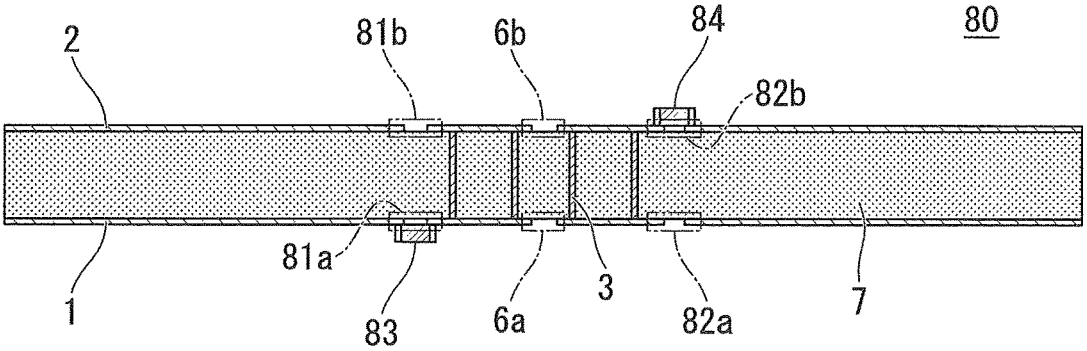
FIG. 32 is a cross-sectional view of an antenna according to a second modified example of the seventh exemplary embodiment of the present invention.

As shown in FIG. 32, it may also be a configuration in which the first chip component 83 is connected to the first spacing 81*a*, and the second chip component 84 is connected to the second second spacing 82*b*.

Figure 33:
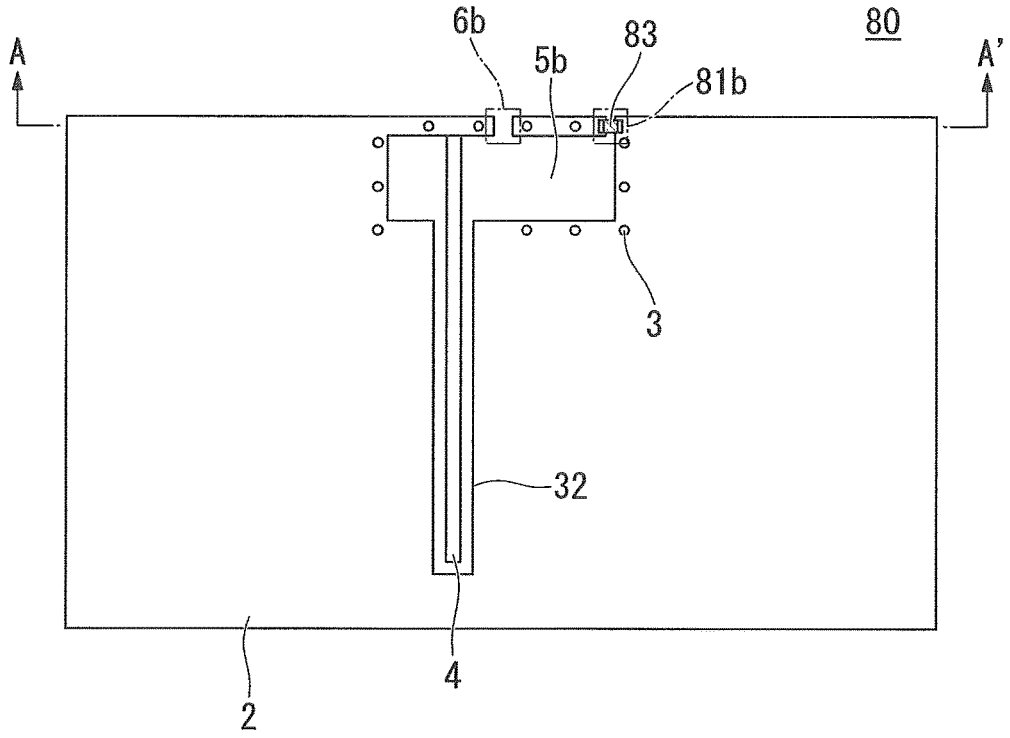
FIG. 33 is a top view of an antenna according to a third modified example of the seventh exemplary embodiment of the present invention.
Figure 34:
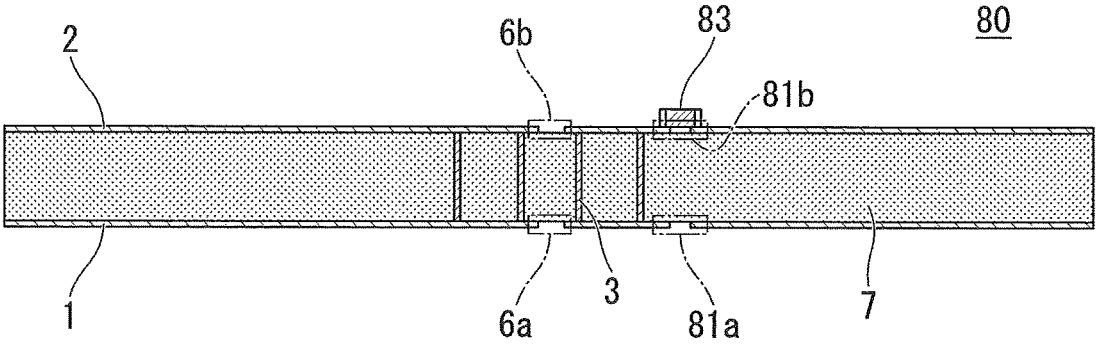
FIG. 34 is a cross-sectional view along line A-A' in FIG. 33.

Here, a case where two spacings are provided for each of the first split ring part 1 and the second split ring part 2 is described as an example. However, a single spacing may be provided for each of the first split ring part 1 and the second split ring part 2. For example, as shown in FIG. 33 and FIG.

34, a configuration where the first spacing 81*a* and the second spacing 81*b* are respectively formed on the first split ring part 1 and the second split ring part 2 such that they overlap in plan view can also be considered.

As a result of such a configuration, the operating frequency of the antenna 80 can be adjusted in exactly the same manner as the case of FIG. 29. Furthermore, the number of chip components can be made smaller compared to the case of FIG. 29, and hence losses resulting from the chip components can be reduced.

Figure 35:
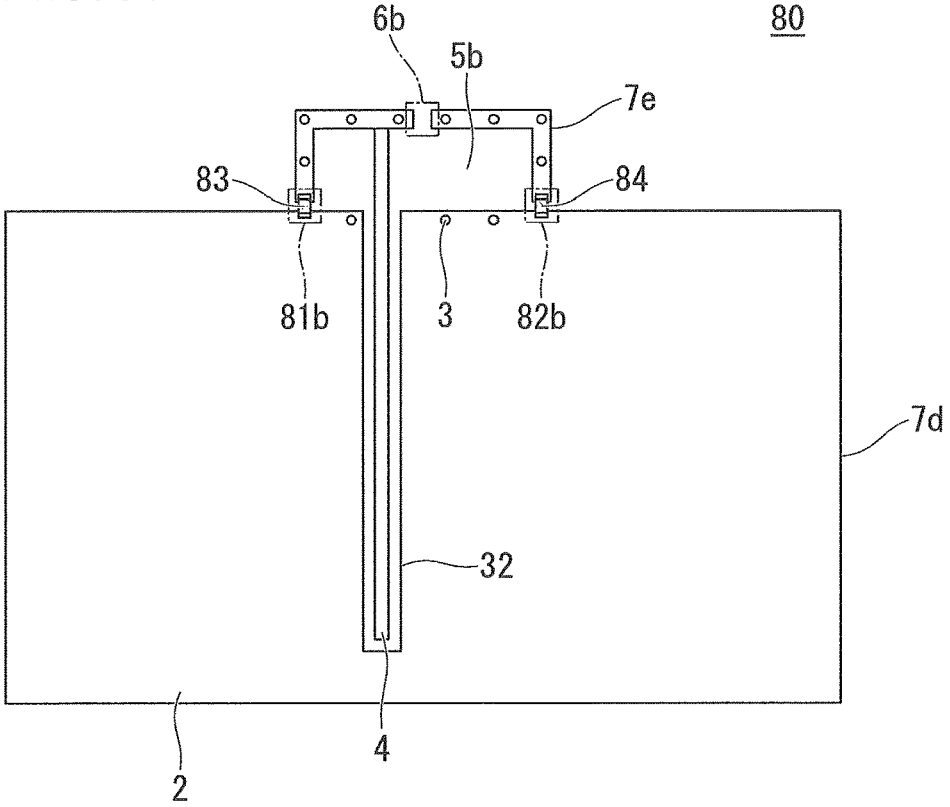
FIG. 35 is a diagram for describing, in the seventh exemplary embodiment of the present invention, a configuration in which an opening part is arranged in a protruding part formed such that the second split ring part protrudes from a rectangular-shaped substrate.

As the shape of the first split ring part 1 and the second split ring part 2, for example a configuration such as shown in FIG. 35 can also be considered. In FIG. 35, the second split ring part 2 is formed on a protruding part 7*e* so as to protrude from a rectangular-shaped substrate 7*d*. The opening part 5*b* is arranged on this protruding part 7*e*. In this case, the first split ring part 1 also is a configuration in which the opening part 5*a* is arranged on the protruding part 7*e*, which is formed protruding from the rectangular-shaped substrate 7*d*.

In the configuration of FIG. 35, the first spacing 81*a* and the second spacing 81*b* are provided for one of the boundaries between the substrate 7*d* and the protruding part 7*e*. Furthermore, the second first spacing 82*a* and the second second spacing 82*b* are provided for the other boundary between the substrate 7*d* and the protruding part 7*e*. As a result of such a configuration, the operating frequency of the antenna 80 can be adjusted in the same manner as the case of FIG. 29.

Figure 36:
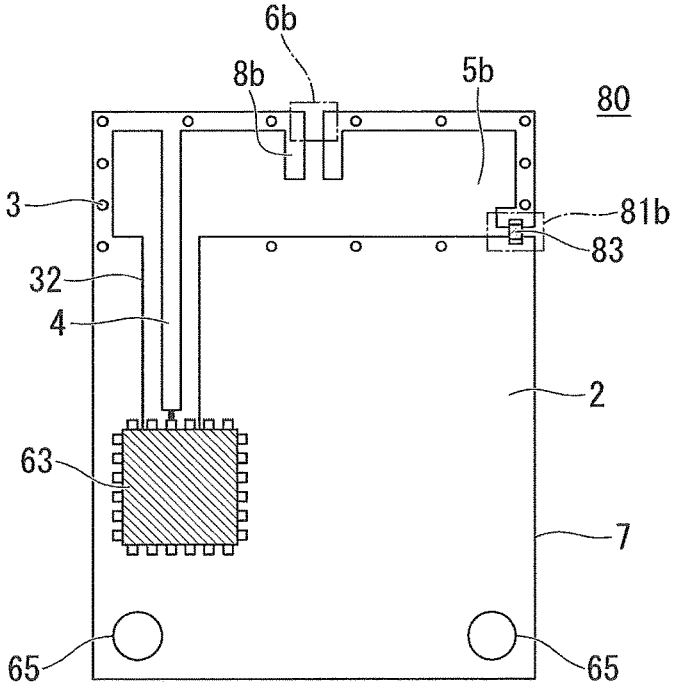
FIG. 36 is a diagram for describing, in the seventh exemplary embodiment of the present invention, a configuration in which an opening part is arranged in a protruding part formed such that the second split ring part protrudes from the rectangular-shaped substrate.

Here, a case based on the third exemplary embodiment is described as an example. However, a configuration based on the other exemplary embodiments can of course also be considered. For example, as shown in FIG. 36, a configuration based on the sixth exemplary embodiment can of course also be considered.

Naturally, the foregoing exemplary embodiments and the plurality of modified examples can be combined within a scope in which the contents thereof do not conflict. Furthermore, in the foregoing exemplary embodiments and the modified examples, the functions and the like of the respective components have been described in detail. The functions thereof can be changed to any type within a scope that satisfies the present invention.

This application is based upon and claims the benefit of priority from Japanese Patent Application No. 2011-182325, filed Aug. 24, 2011, and Japanese Patent Application No. 2012-024848, filed Feb. 8, 2012, the disclosure of which is incorporated herein in its entirety by reference.

INDUSTRIAL APPLICABILITY

The present invention can be applied to an antenna and an electronic device including an antenna. An antenna to which the present invention is applied, and an electronic device including this antenna, while being compact in size, operate over a broad band, and can be manufactured at a low cost.

REFERENCE SYMBOLS

1 First split ring part
2 Second split ring part
3 Conductor via
4 Power feed line
5*a*, 5*b*, 5*c* Opening part
6*a* Split part (first split part)
6*b* Split part (second split part)
6*c* Split part
7 Dielectric multilayer substrate
7A Conductor layer (first conductor layer)
7B Conductor layer (third conductor layer)
7C Conductor layer (second conductor layer)
7*d* Substrate
7*e* Protruding part
8*a*, 8*b* Auxiliary conductor pattern
9 Conductor land pattern
10, 20, 30, 40, 50, 60, 80 Antenna
21 Third split ring part (second split ring part)
2, 32 Clearance
41 Split ring resonator
51 First antenna
52 Second antenna
63 RF circuit
65 Fixing screw hole (electrically connecting part)
67 Conductive screw (electrically connecting part)
68 Parent substrate
69 Ground plane
70 Electronic device
80 Antenna
81*a* First spacing
81*b* Second spacing
83 First chip component
84 Second chip component

What is claimed is:

1. An antenna, comprising:

a dielectric multilayer substrate that includes a first conductor layer and a second conductor layer different from the first conductor layer, the first conductor layer including a first conductor, the first conductor including a first split ring part, the first split ring part surrounding a first opening part and being divided by a first split part; and a power feed line that is provided on the second conductor layer, the power feed line including a first end and a second end, the first end being connected to the first split ring part, the second end spanning the first opening part and extending to a region opposing the first conductor, the power feed line overlapping with the first opening part when seen in a direction in which the first conductor layer and the second conductor layer overlap with each other.

2. The antenna according to claim 1, wherein the dielectric multilayer substrate further includes a third conductor layer including a second conductor, wherein the second conductor includes a second split ring part, the second split ring part surrounding a second opening part and being divided by a second split part, and wherein the first conductor and the second conductor are connected to each other via a plurality of conductor vias.

3. An electronic device comprising at least one antenna according to claim 1.

4. An antenna, comprising:

a dielectric multilayer substrate that includes a first conductor layer and a second conductor layer, the first conductor layer including a first conductor, the first conductor including a first split ring part, the first split ring part surrounding a first opening part and being divided by a first split part, and the second conductor layer including a second conductor, the second conductor including a second split ring part, the second split ring part surrounding a second opening part and being divided by a second split part, the second conductor being connected to the first conductor via a plurality of conductor vias; and a power feed line that is provided on the second conductor layer, the power feed line including a first end and a second end, the first end being connected to an edge of the second opening part, the second end spanning the second opening part and extending to a region opposing the first conductor, the power feed line overlapping with the second opening part when seen in a direction in which the first conductor layer and the second conductor layer overlap with each other, wherein a clearance is provided between the power feed line and the second conductor, in the region to which the power feed line extends.

5. An electronic device comprising at least one antenna according to claim 4.

6. The antenna according to claim 1, wherein the power feed line extends from the first end to the second end approximately in a straight line.

7. The antenna according to claim 1, wherein the first split part extends in a circumferential direction of the first opening part.

8. The antenna according to claim 1, further comprising conductor vias provided in a circumferential direction of the first split part and the second split part, the conductor vias electrically connecting the first split ring part and the second split ring part.

9. The antenna according to claim 8, wherein the first end is electrically connected to at least one of the conductor vias.

10. The antenna according to claim 1, wherein, when viewed in the direction in which the first conductor layer and the second conductor layer overlap with each other, the power feed line extends from the first end to the second end in a straight line across a width direction of the first opening part.

11. The antenna according to claim 1, wherein, when viewed in the direction in which the first conductor layer and the second conductor layer overlap with each other, the power feed line extends from the first end to the second end in a straight line perpendicular to a longitudinal direction of an extension of the first opening part.

12. The antenna according to claim 1, wherein an entirety of the power feed line extends in a straight line.

13. The antenna according to claim 1, wherein, when viewed in the direction in which the first conductor layer and the second conductor layer overlap with each other, the power feed line overlaps with an area of the first opening part that is confined within the first split ring part.

14. The antenna according to claim 1, wherein, when viewed in the direction in which the first conductor layer and the second conductor layer overlap with each other, the power feed line overlaps with an area of the first opening part that is encircled by the first split ring part.

15. The antenna according to claim 4, wherein the power feed line extends from the first end to the second end approximately in a straight line.

16. The antenna according to claim 4, wherein, when viewed in the direction in which the first conductor layer and the second conductor layer overlap with each other, the power feed line extends from the first end to the second end in a straight line across a width direction of the second opening part.

17. The antenna according to claim 4, wherein, when viewed in the direction in which the first conductor layer and the second conductor layer overlap with each other, the power feed line extends from the first end to the second end in a straight line perpendicular to a longitudinal direction of an extension of the second opening part.

18. The antenna according to claim 4, wherein an entirety of the power feed line extends in a straight line.

19. The antenna according to claim 4, wherein, when viewed in the direction in which the first conductor layer and the second conductor layer overlap with each other, the power feed line overlaps with an area of the second opening part that is confined within the second split ring part.

20. The antenna according to claim 1, Wherein, when viewed in the direction in which the first conductor layer and the second conductor layer overlap with each other, the power feed line overlaps with an area of the second opening part that is encircled by the second split ring part.

* * * * *